US009570085B2

(12) United States Patent
Disch et al.

(10) Patent No.: US 9,570,085 B2
(45) Date of Patent: Feb. 14, 2017

(54) APPARATUS AND METHOD FOR EFFICIENT SYNTHESIS OF SINUSOIDS AND SWEEPS BY EMPLOYING SPECTRAL PATTERNS

(71) Applicant: Fraunhofer-Gesellschaft zur Foerderung der angewandten Forschung e.V., Munich (DE)

(72) Inventors: Sascha Disch, Fuerth (DE); Benjamin Schubert, Nuremberg (DE); Ralf Geiger, Erlangen (DE); Bernd Edler, Fuerth (DE); Martin Dietz, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/682,015

(22) Filed: Apr. 8, 2015

(65) Prior Publication Data

US 2015/0213808 A1 Jul. 30, 2015

Related U.S. Application Data

(63) Continuation of application No. PCT/EP2013/069592, filed on Sep. 20, 2013.
(Continued)

(30) Foreign Application Priority Data

Dec. 21, 2012 (EP) ..... 12199266

(51) Int. Cl.
*G10L 19/02* (2013.01)
*G10L 19/032* (2013.01)

(52) U.S. Cl.
CPC ..... *G10L 19/02* (2013.01); *G10L 19/032* (2013.01); *G10L 19/0212* (2013.01)

(58) Field of Classification Search
USPC ..... 704/200–230, 500–504
See application file for complete search history.

(56) References Cited

U.S. PATENT DOCUMENTS 5,680,130 A * 10/1997 Tsutsui ..... H04B 1/665 341/50
7,693,709 B2 * 4/2010 Thumpudi ..... G10L 19/008 704/205

(Continued)

FOREIGN PATENT DOCUMENTS

EP 09713295 A1 5/1996
JP 2002314432 A 10/2002

(Continued)

OTHER PUBLICATIONS

Daudet, L. et al., "MDCT analysis of sinusoids: exact results and applications to coding artifacts reduction", IEEE Transactions on Speech and Audio Processing,, vol. 12, No. 3, May 2004, pp. 302-312.

(Continued)

*Primary Examiner* — Abul Azad
(74) *Attorney, Agent, or Firm* — Michael A. Glenn; Perkins Coie LLP

(57) ABSTRACT

An apparatus for generating an audio output signal based on an encoded audio signal spectrum is provided. The apparatus has a processing unit for processing the encoded audio signal spectrum to obtain a decoded audio signal spectrum having a plurality of spectral coefficients, wherein each of the spectral coefficients has a spectral location within the encoded audio signal spectrum and a spectral value. Moreover, the apparatus has a pseudo coefficients determiner for determining one or more pseudo coefficients. Furthermore, (Continued)

the apparatus has a replacement unit for replacing at least one or more pseudo coefficients by a determined spectral pattern to obtain a modified audio signal spectrum, wherein each of at least two pattern coefficients has a spectral value. Moreover, the apparatus has a spectrum-time-conversion unit for converting the modified audio signal spectrum to a time-domain.

23 Claims, 17 Drawing Sheets

Related U.S. Application Data

(60) Provisional application No. 61/712,013, filed on Oct. 10, 2012.

(56) References Cited

U.S. PATENT DOCUMENTS

| | | | | |
|---|---|---|---|---|
| 2004/0225505 | A1* | 11/2004 | Andersen | G10L 21/038 704/500 |
| 2010/0324708 | A1* | 12/2010 | Ojanpera | G10L 19/008 700/94 |

FOREIGN PATENT DOCUMENTS

| | | | |
|---|---|---|---|
| JP | 2003029797 | A | 1/2003 |
| JP | 2007501441 | A | 1/2007 |
| KR | 1020120000091 | A | 1/2012 |
| RU | 2459282 | C2 | 8/2012 |
| WO | 9501680 | A1 | 1/1995 |
| WO | 9527335 | A1 | 10/1995 |
| WO | 2010/016271 | A1 | 2/2010 |
| WO | 2011/000780 | A1 | 1/2011 |
| WO | 2012/110415 | A1 | 8/2012 |

OTHER PUBLICATIONS

Digilent, Inc., "Analog Discovery Quickstart #1: Welcome", XP054975263, Retrieved from the Internet: URL:http://www.youtube.comjwatch?v=bdEFJAw UtYO [retrieved on Dec. 6, 2013] the whole document, Aug. 3, 2012, 1 page.

Ferreira, A., "Combined Spectral Envelope Normalization and Subtraction of Sinusoidal Components in the ODFT and MDCT Frequency Domains", 2001 IEEE Workshop on Applications of Signal Processing to Audio and Acoustics, Oct. 2001, pp. 51-54.

Goodwin M. et al., "Overlap-Add Synthesis of Nonstationary Sinusoids", International Computer Music Conference Proceedings. XP055091924, Retrieved from the Internet: URL:http://hdl.handle.net/2027/spo.bbp2372.1995.103 [retrieved on Dec. 6, 2013] the whole document, Jan. 1, 1995, 2 pages.

Goodwin, Michael M., "Adaptive Signal Models: Theory, Algorithms, and Audio Applications", A dissertation submitted in partial satisfaction of the requirements for the degree of Doctor of Philosophy in Engineering—Electrical Engineering and Computer Science in the Graduate Division of the University of California, Berkeley, Fall 1997, 274 pages.

* cited by examiner

APPARATUS AND METHOD FOR EFFICIENT SYNTHESIS OF SINUSOIDS AND SWEEPS BY EMPLOYING SPECTRAL PATTERNS

CROSS-REFERENCE TO RELATED APPLICATIONS

This application is a continuation of copending International Application No. PCT/EP2013/069592, filed Sep. 20, 2013, which is incorporated herein by reference in its entirety, and additionally claims priority from U.S. Provisional Application No. 61/712,013, filed Oct. 10, 2012, and from European Application No. 12199266.3, filed Dec. 21, 2012, which are also incorporated herein by reference in their entirety.

BACKGROUND OF THE INVENTION

The present invention relates to audio signal encoding, decoding and processing, and, in particular, to efficient synthesis of sinusoids and sweeps by employing spectral patterns.

Audio signal processing becomes more and more important. Challenges arise, as modern perceptual audio coders are necessitated to deliver satisfactory audio quality at increasingly low bit rates. Additionally, often the permissible latency is also very low, e.g. for bi-directional communication applications or distributed gaming etc.

Modern waveform preserving transform audio coders often come with parametrically coded enhancements, like noise substitution or bandwidth extension. In addition to these well-known parametric tools, it might also be desirable to synthesize sinusoidal tones in such a decoder from parametric side information. Computational complexity is an important criterion in codec development since a low complexity is essential for a wide acceptance and deployment of a codec. Therefore, efficient ways of generating these tones are needed.

For example, MPEG-D USAC (MPEG-D=Moving Picture Experts Group-D; USAC=Unified Speech and Audio Coding) audio codecs often switch between time domain predictive coding and transform domain coding, nevertheless music content is still predominantly coded in the transform domain. At low bit rates, e.g. <14 kbit/s, tonal components in music items often sound bad when coded through transform coders, which makes the task of coding audio at sufficient quality even more challenging.

Additionally, low-delay constraints generally lead to a sub-optimal frequency response of the transform coder's filter bank (due to low-delay optimized window shape and/or transform length) and therefore further compromise the perceptual quality of such codecs.

According to the classic psychoacoustic model, pre-requisites for transparency with respect to quantization noise are defined. At high bit rates, this relates to a perceptually adapted optimal time/frequency distribution of quantization noise that obeys the human auditory masking levels. At low bit rates, however, transparency cannot be reached. Therefore, a masking level requirements reduction strategy may be employed at low bit rates.

Already, top-notch codecs have been provided for music content, in particular, transform coders based on the Modified Discrete Cosine Transform (MDCT), which quantize and transmit spectral coefficients in the frequency domain. However, at very low data rates, only very few spectral lines of each time frame can be coded by the available bits for that frame. As a consequence, temporal modulation artifacts and so-called warbling artifacts are inevitably introduced into the coded signal.

Most prominently, these types of artifacts are perceived in quasi-stationary tonal components. This happens especially if, due to delay constraints, a transform window shape has to be chosen that induces significant crosstalk between adjacent spectral coefficients (spectral broadening) due to the well-known leakage effect. However, nonetheless usually only one or few of these adjacent spectral coefficients remain non-zero after the coarse quantization by the low-bit rate coder.

As stated above, in known technology, according to one approach, transform coders are employed. Contemporary high compression ratio audio codecs that are well-suited for coding of music content all rely on transform coding. Most prominent examples are MPEG2/4 Advanced Audio Coding (AAC) and MPEG-D Unified Speech and Audio Coding (USAC). USAC has a switched core consistent of an Algebraic Code Excited Linear Prediction (ACELP) module plus a Transform Coded Excitation (TCX) module (see [5]) intended mainly for speech coding and, alternatively, AAC mainly intended for coding of music. Like AAC, also TCX is a transform based coding method. At low bit rate settings, these coding schemes are prone to exhibit warbling artifacts, especially if the underlying coding schemes are based on the Modified Discrete Cosine Transform (MDCT) (see [1]).

For music reproduction, transform coders are an advantageous technique for audio data compression. However, at low bit rates, traditional transform coders exhibit strong warbling and roughness artifacts. Most of the artifacts originate from too sparsely coded tonal spectral components. This happens especially if these are spectrally smeared by a suboptimal spectral transfer function (leakage effect) that is mainly designed to meet strict delay constraints.

According to another approach in known technology, the coding schemes are fully parametric for transients, sinusoids and noise. In particular, for medium and low bit rates, fully parametric audio codecs have been standardized, the most prominent of which are MPEG-4 Part 3, Subpart 7 Harmonic and Individual Lines plus Noise (HILN) (see [2]) and MPEG-4 Part 3, Subpart 8 SinuSoidal Coding (SSC) (see [3]). Parametric coders, however, suffer from an unpleasantly artificial sound and, with increasing bit rate, do not scale well towards perceptual transparency.

A further approach provides hybrid waveform and parametric coding. In [4], a hybrid of transform based waveform coding and MPEG 4-SSC (sinusoidal part only) is proposed. In an iterative process, sinusoids are extracted and subtracted from the signal to form a residual signal to be coded by transform coding techniques. The extracted sinusoids are coded by a set of parameters and transmitted alongside with the residual. In [6], a hybrid coding approach is provided that codes sinusoids and residual separately. In [7], at the so-called Constrained Energy Lapped Transform (CELT) codec/Ghost webpage, the idea of utilizing a bank of oscillators for hybrid coding is depictured. However, generating artificial tones by a bank of oscillators that runs in parallel with the decoder and the output of which is mixed with the output of the synthesis filter bank of the decoder in time domain, means a huge computational burden, since many oscillators have to be computed in parallel at a high sampling rate. Computational complexity is an important criterion in codec development and deployment, therefore more efficient ways of generating these tones are needed.

At medium or higher bit rates, transform coders are well-suited for coding of music due to their natural sound. There, the transparency requirements of the underlying psychoacoustic model are fully or almost fully met. However, at low bit rates, coders have to seriously violate the requirements of the psychoacoustic model and in such a situation transform coders are prone to warbling, roughness, and musical noise artifacts.

Although fully parametric audio codecs are most suited for lower bit rates, they are, however, known to sound unpleasantly artificial. Moreover, these codecs do not seamlessly scale to perceptual transparency, since a gradual refinement of the rather coarse parametric model is not feasible.

Hybrid waveform and parametric coding could potentially overcome the limits of the individual approaches and could potentially benefit from the mutual orthogonal properties of both techniques. However, it is, in the current state of the art, hampered by a lack of interplay between the transform coding part and the parametric part of the hybrid codec.

Problems relate to signal division between parametric and transform codec part, bit budget steering between transform and parametric part, parameter signalling techniques and seamless merging of parametric and transform codec output.

Further previous publications in the field relate to synthesis of sinusoidal tones directly in time domain, or piecewise constant tones in DFT frequency domain [13], and to the SNR optimization of truncated patterns in DFT domain [12]. The embedding of piecewise constant frequency tones based on MDCT spectra in a perceptual codec environment [10] or a bandwidth extension scenario [11] has already been described. However, the efficient generation of sweeps and their linkage to seamless tracks in MDCT domain has seemingly not been addressed yet, nor has the definition of sensible restrictions on the available degrees of freedom in the parameter space.

SUMMARY

According to an embodiment, an apparatus for generating an audio output signal based on an encoded audio signal spectrum may have: a processing unit for processing the encoded audio signal spectrum to obtain a decoded audio signal spectrum comprising a plurality of spectral coefficients, wherein each of the spectral coefficients has a spectral location within the encoded audio signal spectrum and a spectral value, wherein the spectral coefficients are sequentially ordered according to their spectral location within the encoded audio signal spectrum so that the spectral coefficients form a sequence of spectral coefficients, a pseudo coefficients determiner for determining one or more pseudo coefficients of the decoded audio signal spectrum, wherein each of the pseudo coefficients is one of the spectral coefficients, a replacement unit for replacing at least one or more pseudo coefficients by a determined spectral pattern to obtain a modified audio signal spectrum, wherein the determined spectral pattern comprises at least two pattern coefficients, wherein each of the at least two pattern coefficients has a spectral value, and a spectrum-time-conversion unit for converting the modified audio signal spectrum to a time-domain to obtain the audio output signal.

According to another embodiment, an apparatus for generating a plurality of spectral patterns may have: a signal generator for generating a plurality of signals in a first domain, a signal transformation unit for transforming each signal of the plurality of signals from the first domain to a second domain to obtain a plurality of spectral patterns, each pattern of the plurality of transformed spectral patterns comprising a plurality of coefficients, a postprocessing unit for truncating the transformed spectral patterns by removing one or more of the coefficients of the transformed spectral patterns to obtain a plurality of processed patterns, and a storage unit comprising a database or a memory, wherein the storage unit is configured to store each processed pattern of the plurality of processed patterns in the database or the memory, wherein the signal generator is configured to generate each signal of the plurality of signals based on the formulae $$x(t)=\cos(2\pi\phi(t))$$

and $$\phi(t)=\phi(0)+\int_0^t 2\pi f(\tau)d\tau,$$

wherein t and $\tau$ indicate time, wherein $\phi(t)$ is an instantaneous phase at t, and wherein $f(\tau)$ is an instantaneous frequency at $\tau$, wherein each signal of the plurality of signals has a start frequency, being an instantaneous frequency of said signal at a first point-in-time, and a target frequency, being an instantaneous frequency of said signal at a different second point-in-time, wherein the signal generator is configured to generate a first signal of the plurality of signals so that the target frequency of the first signal is equal to the start frequency, and wherein the signal generator is configured to generate a different second signal of the plurality of signals so that the target frequency of the first signal is different from the start frequency.

According to another embodiment, a method for generating an audio output signal based on an encoded audio signal spectrum may have the steps of: processing the encoded audio signal spectrum to obtain a decoded audio signal spectrum comprising a plurality of spectral coefficients, wherein each of the spectral coefficients has a spectral location within the encoded audio signal spectrum and a spectral value, wherein the spectral coefficients are sequentially ordered according to their spectral location within the encoded audio signal spectrum so that the spectral coefficients form a sequence of spectral coefficients, determining one or more pseudo coefficients of the decoded audio signal spectrum, wherein each of the pseudo coefficients is one of the spectral coefficients, replacing at least one or more pseudo coefficients by a determined spectral pattern to obtain a modified audio signal spectrum, wherein the determined spectral pattern comprises at least two pattern coefficients, wherein each of the at least two pattern coefficients has a spectral value, and converting the modified audio signal spectrum to a time-domain to obtain the audio output signal.

According to still another embodiment, a method for generating a plurality of spectral patterns may have the steps of: generating a plurality of signals in a first domain, transforming each signal of the plurality of signals from the first domain to a second domain to obtain a plurality of spectral patterns, each pattern of the plurality of transformed spectral patterns comprising a plurality of coefficients, truncating the transformed spectral patterns by removing one or more of the coefficients of the transformed spectral patterns to obtain a plurality of processed patterns, and storing each processed pattern of the plurality of processed patterns in a database or a memory, wherein generating each signal of the plurality of signals is conducted based on the formulae $$x(t)=\cos(2\pi\phi(t))$$

and $$\phi(t)=\phi(0)+\int_0^t 2\pi f(\tau)d\tau,$$

wherein t and τ indicate time, wherein φ(t) is an instantaneous phase at t, and wherein f(τ) is an instantaneous frequency at τ, wherein each signal of the plurality of signals has a start frequency, being an instantaneous frequency of said signal at a first point-in-time, and a target frequency, being an instantaneous frequency of said signal at a different second point-in-time, wherein generating the plurality of signals is conducted by generating a first signal of the plurality of signals so that the target frequency of the first signal is equal to the start frequency, and wherein generating the plurality of signals is conducted by generating a different second signal of the plurality of signals so that the target frequency of the first signal is different from the start frequency.

Another embodiment may have a computer program for implementing the above methods when being executed on a computer or signal processor.

In an embodiment, the apparatus furthermore may comprise a storage unit comprising a database or a memory having stored within the database or within the memory a plurality of stored spectral patterns, wherein each of the stored spectral patterns has a certain spectral property (e.g. constant frequency, sweeping frequency—each in an on-bin or a between-bin location version—etc.). The replacement unit may be configured to request one of the stored spectral patterns as a requested spectral pattern from the storage unit. The storage unit may be configured to provide said requested spectral pattern, and the replacement unit may be configured to replace the at least one or more pseudo coefficients by the determined spectral pattern based on the requested spectral pattern.

According to an embodiment, the replacement unit may be configured to request said one of the stored spectral patterns from the storage unit depending on a first derived spectral location derived from at least one of the one or more pseudo coefficients determined by the pseudo coefficients determiner.

In one embodiment, the first derived spectral location derived from at least one of the one or more pseudo coefficients may be the spectral location of one of the pseudo coefficients.

In another embodiment, the one or more pseudo coefficients are signed values, each comprising a sign component, and the replacement unit is configured to determine the first derived spectral location based on the spectral location of one pseudo coefficient of the one or more pseudo coefficients and based on the sign component of said pseudo coefficient, so that the first derived spectral location is equal to the spectral location of said pseudo coefficient when the sign component has a first sign value, and so that the first derived spectral location is equal to a modified location, the modified location resulting from shifting the spectral location of said pseudo coefficient by a predefined value when the sign component has a different second value.

For example, a half-bin frequency resolution of the pseudo-lines can be signalled by the sign of said pseudo coefficient. The predefined value by which the spectral location of said pseudo coefficient is shifted may then correspond to half of the frequency difference, e.g. of two subsequent bins, for example, when a time-frequency domain is considered, when the sign component of the pseudo coefficient has the second sign value.

The sign component of the pseudo coefficient may be comprised by the spectral value of the pseudo coefficient.

In an embodiment, the plurality of stored spectral patterns being stored within the database or the memory of the storage unit may be either stationary tone patterns or frequency sweep patterns. The pseudo coefficients determiner may be configured to determine two or more temporally consecutive pseudo coefficients of the decoded audio signal spectrum. The replacement unit may be configured to assign a first pseudo coefficient and a second pseudo coefficient of the two or more temporally consecutive pseudo coefficients to a track depending on whether an absolute difference between the first derived spectral location derived from the first pseudo coefficient and a second derived spectral location derived from the second pseudo coefficient is smaller than a threshold value. And, the replacement unit may be configured to request one of the stationary tone patterns from the storage unit when the first derived spectral location derived from the first pseudo coefficient of the track is equal to the second derived spectral location derived from the second pseudo coefficient of the track. Furthermore, the replacement unit may be configured to request one of the frequency sweep patterns from the storage unit when the first derived spectral location derived from the first pseudo coefficient of the track is different from the second derived spectral location derived from the second pseudo coefficient of the track.

According to an embodiment, the replacement unit may be configured to request a first frequency sweep pattern of the frequency sweep patterns from the storage unit when a frequency difference between the second derived spectral location derived from the second pseudo coefficient of the track and the first derived spectral location derived from the first pseudo coefficient of the track is equal to half of a predefined value. Moreover, the replacement unit may be configured to request a second frequency sweep pattern, being different from the first frequency sweep pattern, of the frequency sweep patterns from the storage unit when the frequency difference between the second derived spectral location derived from the second pseudo coefficient of the track and the first derived spectral location derived from the first pseudo coefficient of the track is equal to the predefined value. Furthermore, the replacement unit may be configured to request a third frequency sweep pattern, being different from the first sweep pattern and the second frequency sweep pattern, of the frequency sweep patterns from the storage unit when the frequency difference between the second derived spectral location derived from the second pseudo coefficient of the track and the first derived spectral location derived from the first pseudo coefficient of the track is equal to one and a half times the predefined value.

According to an embodiment, the replacement unit comprises a pattern adaptation unit being configured to modify the requested spectral pattern provided by the storage unit to obtain the determined spectral pattern.

In an embodiment, the pattern adaptation unit may be configured to modify the requested spectral pattern provided by the storage unit by rescaling the spectral values of the pattern coefficients of the requested spectral pattern depending on the spectral value of one of the one or more pseudo coefficients to obtain the determined spectral pattern.

According to an embodiment, the pattern adaptation unit may be configured to modify the requested spectral pattern provided by the storage unit depending on a start phase so that the spectral value of each of the pattern coefficients of the requested spectral pattern is modified in a first way, when the start phase has a first start phase value, and so that the spectral value of each of the pattern coefficients of the requested spectral pattern is modified in a different second way, when the start phase has a different second start phase value.

According to an embodiment, the spectral value of each of the pattern coefficients of the requested spectral pattern may be a complex coefficient comprising a real part and an imaginary part. In such an embodiment, the pattern adaptation unit may be configured to modify the requested spectral pattern by modifying the real part and the imaginary part of each of the pattern coefficients of the requested spectral pattern provided by the storage unit, by applying a complex rotation factor $e^{j\Phi}$, wherein $\phi$ is an angle (e.g. angle value). By this, for each of the complex coefficients a vector representing said complex coefficient in a complex plane is rotated by the same angle for each of the complex coefficients.

In an embodiment, the spectral value of each of the pattern coefficients of the requested spectral pattern comprises a real part and an imaginary part. The pattern adaptation unit may be configured to modify the requested spectral pattern provided by the storage unit by negating the real and the imaginary part of the spectral value of each of the pattern coefficients of the requested spectral pattern, or by swapping the real part or a negated real part and the imaginary part or a negated imaginary part of the spectral value of each of the pattern coefficients of the requested spectral pattern.

In an embodiment, the pattern adaptation unit may be configured to modify the requested spectral pattern provided by the storage unit by realizing a temporal mirroring of the pattern. Typically, this can be obtained in a frequency domain by computing the complex conjugate (by multiplication of the imaginary part by −1) of the pattern and applying a complex phase term (twiddle).

According to an embodiment, the decoded audio signal spectrum is represented in an MDCT domain. The pattern adaptation unit may be configured to modify the requested spectral pattern provided by the storage unit by modifying the spectral values of the pattern coefficients of the requested spectral pattern to obtain a modified spectral pattern, wherein the spectral values are represented in an Oddly-Stacked Discrete Fourier Transform domain. Furthermore, the pattern adaptation unit may be configured to transform the spectral values of the pattern coefficients of the modified spectral pattern from the Oddly-Stacked Discrete Fourier Transform domain to the MDCT domain to obtain the determined spectral pattern. Moreover, the replacement unit may be configured to replace the at least one or more pseudo coefficients by the determined spectral pattern being represented in the MDCT domain to obtain the modified audio signal spectrum being represented in the MDCT domain.

Alternatively, in embodiments the spectral values may be represented in a Complex Modified Discrete Cosine Transform (CMDCT) domain. Furthermore, in these embodiments the pattern adaptation unit may be configured to transform the spectral values of the pattern coefficients of the modified spectral pattern from the CMDCT domain to the MDCT domain to obtain the determined spectral pattern by simply extracting the real part of the complex modified pattern.

Moreover, an apparatus for generating a plurality of spectral patterns is provided. The apparatus comprises a signal generator for generating a plurality of signals in a first domain. Furthermore, the apparatus comprises a signal transformation unit for transforming each signal of the plurality of signals from the first domain to a second domain to obtain a plurality of spectral patterns, each pattern of the plurality of transformed spectral patterns comprising a plurality of coefficients. Moreover, the apparatus comprises a postprocessing unit for truncating the transformed spectral patterns by removing one or more of the coefficients of the transformed spectral patterns to obtain a plurality of processed patterns. Furthermore, the apparatus comprises a storage unit comprising a database or a memory, wherein the storage unit is configured to store each processed pattern of the plurality of processed patterns in the database or the memory. The signal generator is configured to generate each signal of the plurality of signals based on the formulae $$x(t)=\cos(2\pi\phi(t))$$

and $$\phi(t)=\phi(0)+\int_0^t 2\pi f(\tau)d\tau,$$

wherein t and $\tau$ indicate time, wherein $\phi(t)$ is an instantaneous phase at t, and wherein $f(\tau)$ is an instantaneous frequency at $\tau$, wherein each signal of the plurality of signals has a start frequency ($f_0$), being an instantaneous frequency of said signal at a first point-in-time, and a target frequency ($f_1$), being an instantaneous frequency of said signal at a different second point-in-time. The signal generator is configured to generate a first signal of the plurality of signals so that the target frequency of the first signal is equal to the start frequency. Moreover, the signal generator is configured to generate a different second signal of the plurality of signals so that the target frequency of the first signal is different from the start frequency.

According to an embodiment, the signal transformation unit may be configured to transform each signal of the plurality of signals from the first domain, being a time domain, to a second domain, being a spectral domain. The signal transformation unit may be configured to generate a first one of a plurality of time blocks for transforming said signal, wherein each time block of the plurality of time blocks comprises a plurality of weighted samples, wherein each of said weighted samples is a signal sample of said signal being weighted by a weight of a plurality of weights, wherein the plurality of weights are assigned to said time block, and wherein each weight of the plurality of weights is assigned to a point-in-time. The start frequency ($f_0$) of each signal of the plurality of signals may be an instantaneous frequency of said signal at the first point-in-time, where a first one of the weights of the first one of the time blocks is assigned to the first point-in-time, where a second one of the weights of a different second one of the time blocks is assigned to the first point-in-time, wherein the first one of the time blocks and the second one of the time blocks overlap, and wherein the first one of the weights is equal to the second one of the weights. The target frequency ($f_1$) of each signal of the plurality of signals may be an instantaneous frequency of said signal at the second point-in-time, where a third one of the weights of the first one of the time blocks is assigned to the second point-in-time, where a fourth one of the weights of a different third one of the time blocks is assigned to the second point-in-time, wherein the first one of the time blocks and the third one of the time blocks overlap, and wherein the third one of the weights is equal to the fourth one of the weights.

It should be noted that it e.g. may be sufficient to generate only one time block (e.g. the first one of the time blocks) for the generation of a pattern.

According to an embodiment, each signal of the plurality of signals has a start phase ($\phi_0$), being a phase of said signal at a first point-in-time, and a target phase ($\phi_1$), being a phase of said signal at a different second point-in-time, wherein the signal generator is configured to generate the plurality of signals such that the start phase ($\phi_0$) of a first one of the plurality signals is equal to the start phase ($\phi_0$) of a different second one of the plurality of the signals.

The start phase (and, implicitly by choice of start and target frequency, the stop phase) of each signal of the plurality of signals may be adjusted at said start and stop points-in-time.

By this special choice of start and stop points-in-time, overlap-add artifacts are reduced that may occur, if patterns with different spectral properties are chained.

In an embodiment, the postprocessing unit may be furthermore configured to conduct a rotation by $\pi/4$ on the spectral coefficients of each of the transformed spectral patterns to obtain a plurality of rotated spectral patterns.

In another embodiment, the postprocessing unit may be furthermore configured to conduct a rotation by an arbitrary phase angle on the spectral coefficients of each of the transformed spectral patterns to obtain a plurality of arbitrarily rotated spectral patterns.

According to a further embodiment, the signal generator may be configured to generate the first signal, the second signal and one or more further signals as the plurality of signals, so that each difference of the target frequency and the start frequency of each of the further signals is an integer multiple of a difference of the target frequency and the start frequency of the second signal.

Furthermore, a method for generating an audio output signal based on an encoded audio signal spectrum is provided. The method comprises:

Processing the encoded audio signal spectrum to obtain a decoded audio signal spectrum comprising a plurality of spectral coefficients, wherein each of the spectral coefficients has a spectral location within the encoded audio signal spectrum and a spectral value, wherein the spectral coefficients are sequentially ordered according to their spectral location within the encoded audio signal spectrum so that the spectral coefficients form a sequence of spectral coefficients.

Determining one or more pseudo coefficients of the decoded audio signal spectrum, wherein each of the pseudo coefficients is one of the spectral coefficients, Replacing at least one or more pseudo coefficients by a determined spectral pattern to obtain a modified audio signal spectrum, wherein the determined spectral pattern comprises at least two pattern coefficients, wherein each of the at least two pattern coefficients has a spectral value. And:

Converting the modified audio signal spectrum to a time-domain to obtain the audio output signal.

Moreover, a method for generating a plurality of spectral patterns is provided. The method comprises:

Generating a plurality of signals in a first domain.

Transforming each signal of the plurality of signals from the first domain to a second domain to obtain a plurality of spectral patterns, each pattern of the plurality of transformed spectral patterns comprising a plurality of coefficients.

Truncating the transformed spectral patterns by removing one or more of the coefficients of the transformed spectral patterns to obtain a plurality of processed patterns. And:

Storing each processed pattern of the plurality of processed patterns in a database or a memory.

Generating each signal of the plurality of signals is conducted based on the formulae $$x(t)=\cos(2\pi\phi(t))$$

and $$\phi(t)=\phi(0)+\int_0^t 2\pi f(\tau)d\tau,$$

wherein t and $\tau$ indicate time, wherein $\phi(t)$ is an instantaneous phase at t, and wherein $f(\tau)$ is an instantaneous frequency at $\tau$, and wherein each signal of the plurality of signals has a start frequency ($f_0$), being an instantaneous frequency of said signal at a first point-in-time, and a target frequency ($f_1$), being an instantaneous frequency of said signal at a different second point-in-time.

Generating the plurality of signals is conducted by generating a first signal of the plurality of signals so that the target frequency ($f_1$) of the first signal is equal to the start frequency ($f_0$). Moreover, generating the plurality of signals is conducted by generating a different second signal of the plurality of signals so that the target frequency ($f_1$) of the first signal is different from the start frequency ($f_0$).

Furthermore, a computer program for implementing the above-described methods when being executed on a computer or signal processor is provided.

Since contemporary codecs like AAC or USAC are based on an MDCT domain representation of audio, embodiments provide concepts for generating synthetic tones by patching tone patterns into the MDCT spectrum at the decoder. It is demonstrated how appropriate spectral patterns can be derived and adapted to their target location in (and between) the MDCT time/frequency (t/f) grid to seamlessly synthesize high quality sinusoidal tones including sweeps.

Contemporary codecs like Advanced Audio Coding (AAC) or Unified Speech and Audio Coding (USAC) are based on a Modified Discrete Cosine Transform (MDCT) domain representation of audio. Embodiments generate synthetic tones by directly patching tone patterns into the MDCT spectrum at the decoder. Only by this, an ultralow complexity implementation can be realized.

In embodiments, appropriate patterns are derived and are adapted to their target location in (and between) the MDCT t/f grid to synthesize high quality sinusoidal tones including sweeps.

According to embodiments, low delay and low bit rate audio coding is provided. Some embodiments are based on a new and inventive concept referred to as ToneFilling (TF). The term ToneFilling denotes a coding technique, in which otherwise badly coded natural tones are replaced by perceptually similar yet pure sine tones. Thereby, amplitude modulation artifacts at a certain rate, dependent on spectral position of the sinusoid with respect to the spectral location of the nearest MDCT bin, are avoided (known as "warbling").

In embodiments, a degree of annoyance of all conceivable artifacts is weighted. This relates to perceptual aspects like e.g. pitch, harmonicity, modulation and to stationary of artifacts. All aspects are evaluated in a Sound Perception Annoyance Model (SPAM). Steered by such a model, ToneFilling provides significant advantages. A pitch and modulation error that is introduced by replacing a natural tone with a pure sine tone, is weighted versus an impact of additive noise and poor stationarity ("warbling") caused by a sparsely quantized natural tone.

ToneFilling provides significant differences to sinusoids-plus-noise codecs. For example, TF substitutes tones by sinusoids and linear sine sweeps with predefined slopes, instead of a subtraction of sinusoids. Perceptually similar tones have the same local Centers Of Gravity (COG) as the original sound component to be substituted. According to embodiments, original tones are erased in the audio spectrum (left to right foot of COG function). Typically, the frequency resolution of the sinusoid used for substitution is as coarse as possible to minimize side information, while, at the same time, accounting for perceptual requirements to avoid an out-of-tune sensation.

In some embodiments, ToneFilling may be conducted above a lower cut-off frequency due to said perceptual requirements, but not below the lower cut-off frequency. When conducting ToneFilling, tones are represented via spectral pseudo-lines within a transform coder. However, in a ToneFilling equipped encoder, pseudo-lines are subjected to the regular processing controlled by the classic psychoacoustic model. Therefore, when conducting ToneFilling, there is no need for a-priori restrictions of the parametric part (at bit rate x, y tonal components are substituted). Such, a tight integration into a transform codec is achieved.

ToneFilling functionality may be employed at the encoder, by detecting local COGs (smoothed estimates; peak quality measures), by removing tonal components, by generating substituted pseudo-lines (e.g. pseudo coefficients) which carry a level information via the amplitude of the pseudo-lines, a frequency information via the spectral position of the pseudo-lines and a fine frequency information (half bin offset) via the sign of the pseudo-lines. Pseudo coefficients (pseudo-lines) are handled by a subsequent quantizer unit of the codec just like any regular spectral coefficient (spectral line).

ToneFilling may moreover be employed at the decoder by detecting isolated spectral lines, wherein true pseudo coefficients (pseudo-lines) may be marked by flag array (e.g. a bit field). The decoder may link pseudo-line information to build sinusoidal tracks. A birth/continuation/death scheme may be employed to synthesize continuous tracks.

For decoding, pseudo coefficients (pseudo-lines) may be marked as such by a flag array transmitted within the side information. A half-bin frequency resolution of the pseudo-lines can be signalled by the sign of the pseudo coefficients (pseudo-lines). At the decoder, the pseudo-lines may be erased from the spectrum before the inverse transform unit and synthesized separately by a bank of oscillators. Over time, pairs of oscillators may be linked and parameter interpolation is employed to ensure a smoothly evolving oscillator output.

The on- and offsets of the parameter-driven oscillators may be shaped such that they closely correspond to the temporal characteristics of the windowing operation of the transform codec thus ensuring seamless transition between transform codec generated parts and oscillator generated parts of the output signal.

The provided concepts integrate nicely and effortlessly into existing transform coding schemes like AAC, TCX or similar configurations. Steering of the parameter quantization precision may be implicitly performed by the codec's existing rate control.

In some embodiments, pseudo-lines (pseudo coefficients) may be handled by the codecs existing quantizer just like any regular spectral line; as opposed to separate signalling of sinusoidal parameters.

In some embodiments, an optionally measured start phase of a sinusoidal track obtained from extrapolation of preceding spectra may be employed.

According to some embodiments, an optional Time Domain Alias Cancellation (TDAC) technique may be employed by modelling of the alias at on-/off-set of a sinusoidal track.

BRIEF DESCRIPTION OF THE DRAWINGS

In the following, embodiments of the present invention are described in more detail with reference to the figures, in which.

DETAILED DESCRIPTION OF THE INVENTION

Figure 7:
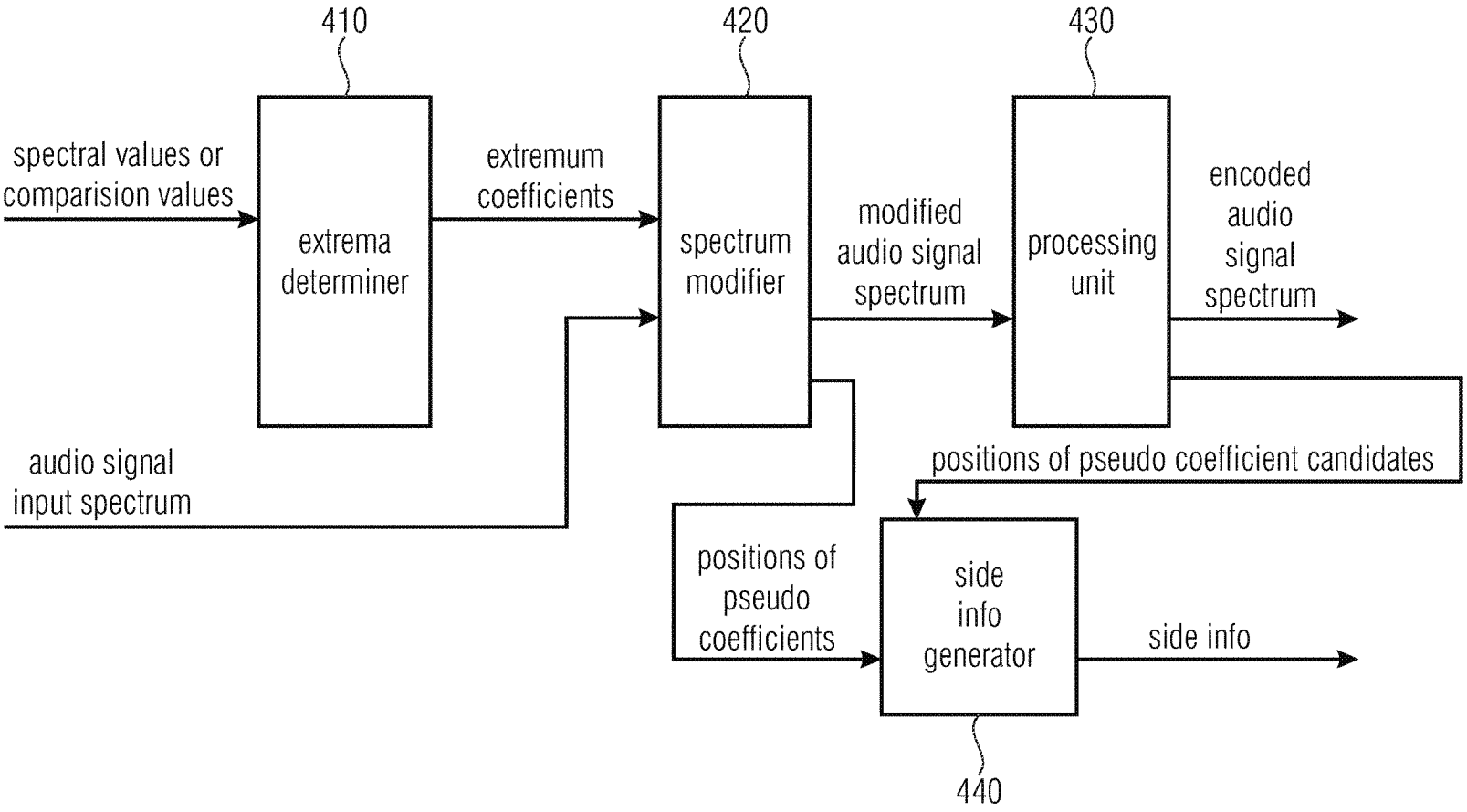
FIG. 7 illustrates an apparatus for encoding an audio signal input spectrum according to an embodiment.

FIG. 7 illustrates an apparatus for encoding an audio signal input spectrum according to an embodiment. The apparatus for encoding comprises an extrema determiner 410, a spectrum modifier 420, a processing unit 430 and a side information generator 440.

Before considering the apparatus of FIG. 7 in more detail, the audio signal input spectrum that is encoded by the apparatus of FIG. 7 is considered in more detail.

In principle any kind of audio signal spectrum can be encoded by the apparatus of FIG. 7. The audio signal input spectrum may, for example, be an MDCT (Modified Discrete Cosine Transform) spectrum, a DFT (Discrete Fourier Transform) magnitude spectrum or an MDST (Modified Discrete Sine Transform) spectrum.

Figure 8:
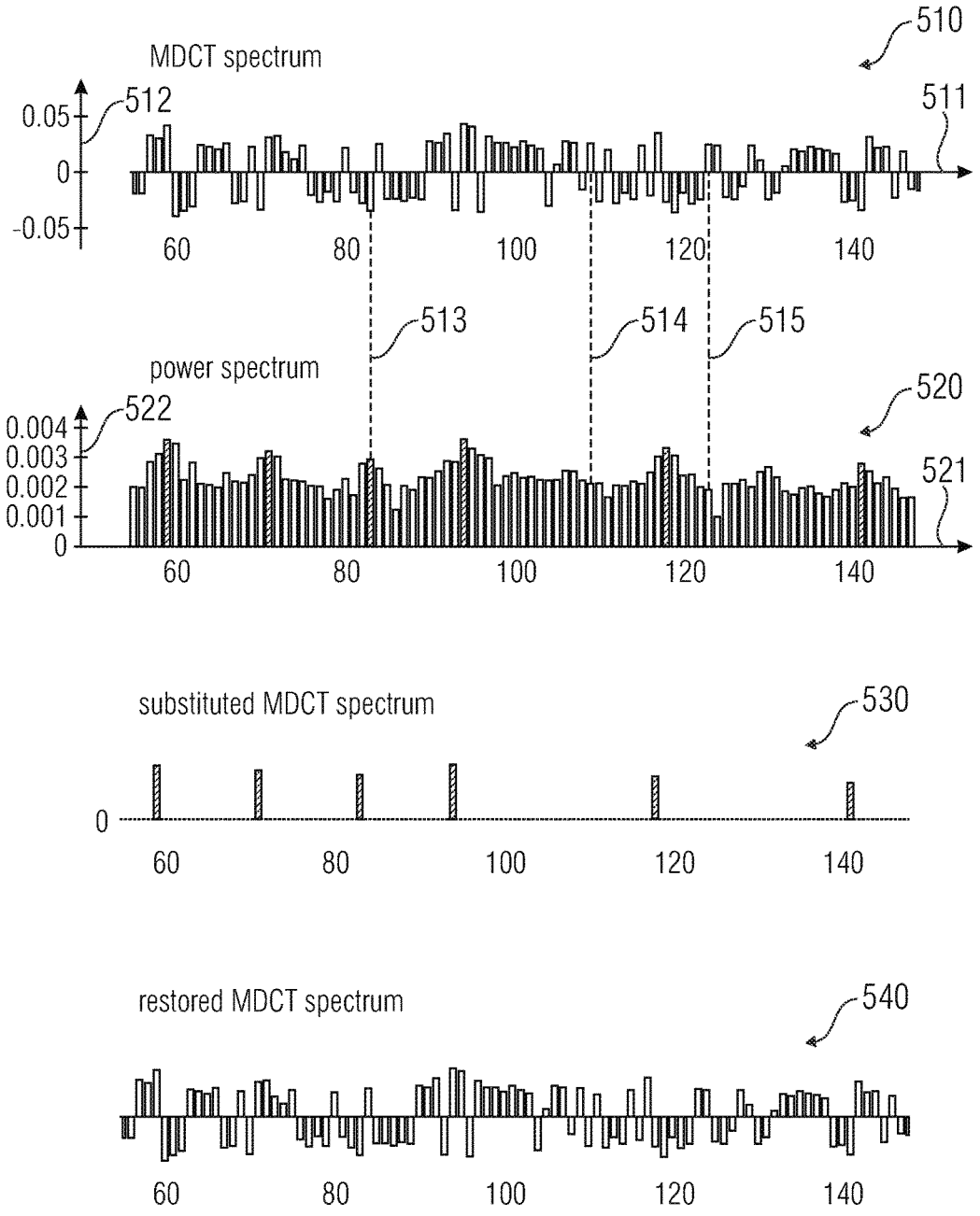
FIG. 8 depicts an audio signal input spectrum, a corresponding power spectrum and a modified (substituted) audio signal spectrum.

FIG. 8 illustrates an example of an audio signal input spectrum 510. In FIG. 8, the audio signal input spectrum 510 is an MDCT spectrum.

The audio signal input spectrum comprises a plurality of spectral coefficients. Each of the spectral coefficients has a spectral location within the audio signal input spectrum and a spectral value.

Considering the example of FIG. 8, where the audio signal input spectrum results from an MDCT transform of the audio signal, e.g., a filter bank that has transformed the audio signal to obtain the audio signal input spectrum, may, for example, use 1024 channels. Then, each of the spectral coefficients is associated with one of the 1024 channels and the channel number (for example, a number between 0 and 1023) may be considered as the spectral location of said spectral coefficients. In FIG. 8, the abscissa 511 refers to the spectral location of the spectral coefficients. For better illustration, only the coefficients with spectral locations between 52 and 148 are illustrated by FIG. 8.

In FIG. 8, the ordinate 512 helps to determine the spectral value of the spectral coefficients. In the example of FIG. 8 which depicts an MDCT spectrum, there, the spectral values of the spectral coefficients of the audio signal input spectrum, the abscissa 512 refers to the spectral values of the spectral coefficients. It should be noted that spectral coefficients of an MDCT audio signal input spectrum can have positive as well as negative real numbers as spectral values.

Other audio signal input spectra, however, may only have spectral coefficients with spectral values that are positive or zero. For example, the audio signal input spectrum may be a DFT magnitude spectrum, with spectral coefficients having spectral values that represent the magnitudes of the coefficients resulting from the Discrete Fourier Transform. Those spectral values can only be positive or zero.

In further embodiments, the audio signal input spectrum comprises spectral coefficients with spectral values that are complex numbers. For example, a DFT spectrum indicating magnitude and phase information may comprise spectral coefficients having spectral values which are complex numbers.

As exemplarily shown in FIG. 8, the spectral coefficients are sequentially ordered according to their spectral location within the audio signal input spectrum so that the spectral coefficients form a sequence of spectral coefficients. Each of the spectral coefficients has at least one of one or more predecessors and one or more successors, wherein each predecessor of said spectral coefficient is one of the spectral coefficients that precedes said spectral coefficient within the sequence. Each successor of said spectral coefficient is one of the spectral coefficients that succeeds said spectral coefficient within the sequence. For example, in FIG. 8, a spectral coefficient having the spectral location 81, 82 or 83 (and so on) is a successor for the spectral coefficient with the spectral location 80. A spectral coefficient having the spectral location 79, 78 or 77 (and so on) is a predecessor for the spectral coefficient with the spectral location 80. For the example of an MDCT spectrum, the spectral location of a spectral coefficient may be the channel of the MDCT transform, the spectral coefficient relates to (for example, a channel number between, e.g. 0 and 1023). Again it should be noted that, for illustrative purposes, the MDCT spectrum 510 of FIG. 8 only illustrates spectral coefficients with spectral locations between 52 and 148.

Returning to FIG. 7, the extrema determiner 410 is now described in more detail. The extrema determiner 410 is configured to determine one or more extremum coefficients.

In general, the extrema determiner 410 examines the audio signal input spectra or a spectrum that is related to the audio signal input spectrum for extremum coefficients. The purpose of determining extremum coefficients is, that later on, one or more local tonal regions shall be substituted in the audio signal spectrum by pseudo coefficients, for example, by a single pseudo coefficient for each tonal region.

In general, peaky areas in a power spectrum of the audio signal, the audio signal input spectrum relates to, indicate tonal regions. It may therefore be of advantage to identify peaky areas in a power spectrum of the audio signal to which the audio signal input spectrum relates. The extrema determiner 410 may, for example, examine a power spectrum, comprising coefficients, which may be referred to as comparison coefficients (as their spectral values are pairwise compared by the extrema determiner), so that each of the spectral coefficients of the audio signal input spectrum has a comparison value associated to it.

In FIG. 8, a power spectrum 520 is illustrated. The power spectrum 520 and the MDCT audio signal input spectrum 510 relate to the same audio signal. The power spectrum 520 comprises coefficients referred to as comparison coefficients. Each spectral coefficient comprises a spectral location which relates to abscissa 521 and a comparison value. Each spectral coefficient of the audio signal input spectrum has a comparison coefficient associated with it and thus, moreover has the comparison value of its comparison coefficient associated with it. For example, the comparison value associated with a spectral value of the audio signal input spectrum may be the comparison value of the comparison coefficient with the same spectral position as the considered spectral coefficient of the audio signal input spectrum. The association between three of the spectral coefficients of the audio signal input spectrum 510 and three of the comparison coefficients (and thus the association with the comparison values of these comparison coefficients) of the power spectrum 520 is indicated by the dashed lines 513, 514, 515 indicating an association of the respective comparison coefficients (or their comparison values) and the respective spectral coefficients of the audio signal input spectrum 510.

The extrema determiner 410 may be configured to determine one or more extremum coefficients, so that each of the extremum coefficients is one of the spectral coefficients the comparison value of which is greater than the comparison value of one of its predecessors and the comparison value of which is greater than the comparison value of one of its successors.

For example, the extrema determiner 410 may determine the local maxima values of the power spectrum. In other words, the extrema determiner 410 may be configured to determine the one or more extremum coefficients, so that each of the extremum coefficients is one of the spectral coefficients the comparison value of which is greater than the comparison value of its immediate predecessor and the comparison value of which is greater than the comparison value of its immediate successor. Here, the immediate predecessor of a spectral coefficient is the one of the spectral coefficients that immediately precedes said spectral coefficient in the power spectrum. The immediate successor of said spectral coefficient is one of the spectral coefficients that immediately succeeds said spectral coefficient in the power spectrum.

However, other embodiments do not require that the extrema determiner 410 determines all local maxima. For example, in some embodiments, the extrema determiner may only examine certain portions of the power spectrum, for example, relating to a certain frequency range, only.

In other embodiments, the extrema determiner 410 is configured to only those coefficients as extremum coefficients, where a difference between the comparison value of the considered local maximum and the comparison value of the subsequent local minimum and/or preceding local minimum is greater than a threshold value.

The extrema determiner 410 may determine the extremum or the extrema on a comparison spectrum, wherein a comparison value of a coefficient of the comparison spectrum is assigned to each of the MDCT coefficients of the MDCT spectrum. However, the comparison spectrum may have a higher spectral resolution than the audio signal input spectrum. For example, the comparison spectrum may be a DFT spectrum having twice the spectral resolution than the MDCT audio signal input spectrum. By this, only every second spectral value of the DFT spectrum is then assigned to a spectral value of the MDCT spectrum. However, the other coefficients of the comparison spectrum may be taken into account when the extremum or the extrema of the comparison spectrum are determined. By this, a coefficient of the comparison spectrum may be determined as an extremum which is not assigned to a spectral coefficient of the audio signal input spectrum, but which has an immediate predecessor and an immediate successor, which are assigned to a spectral coefficient of the audio signal input spectrum and to the immediate successor of that spectral coefficient of the audio signal input spectrum, respectively. Thus, it can be considered that said extremum of the comparison spectrum (e.g. of the high-resolution DFT spectrum) is assigned to a spectral location within the (MDCT) audio signal input spectrum which is located between said spectral coefficient of the (MDCT) audio signal input spectrum and said immediate successor of said spectral coefficient of the (MDCT) audio signal input spectrum. Such a situation may be encoded by choosing an appropriate sign value of the pseudo coefficient as explained later on. By this, sub-bin resolution is achieved.

It should be noted that in some embodiments, an extremum coefficient does not have to fulfil the requirement that its comparison value is greater than the comparison value of its immediate predecessor and the comparison value of its immediate successor. Instead, in those embodiments, it might be sufficient that the comparison value of the extremum coefficient is greater than one of its predecessors and one of its successors. Consider for example the situation, where:

TABLE 1

| Spectral Location | 212 | 213 | 214 | 215 | 216 |
|---|---|---|---|---|---|
| Comparison Value | 0.02 | 0.84 | 0.83 | 0.85 | 0.01 |

In the situation described by Table 1, the extrema determiner 410 may reasonably consider the spectral coefficient at spectral location 214 as an extremum coefficient. The comparison value of spectral coefficient 214 is not greater than that of its immediate predecessor 213 (0.83<0.84) and not greater than that of its immediate successor 215 (0.83<0.85), but it is (significantly) greater than the comparison value of another one of its predecessors, predecessor 212 (0.83>0.02), and it is (significantly) greater than the comparison value of another one of its successors, successor 216 (0.83>0.01). It appears moreover reasonable to consider spectral coefficient 214 as the extremum of this "peaky area", as spectral coefficient is located in the middle of the three coefficients 213, 214, 215 which have relatively big comparison values compared to the comparison values of coefficients 212 and 216.

For example, the extrema determiner 410 may be configured to determine form some or all of the comparison coefficients, whether the comparison value of said comparison coefficient is greater than at least one of the comparison values of the three predecessors being closest to the spectral location of said comparison coefficient. And/or, the extrema determiner 410 may be configured to determine form some or all of the comparison coefficients, whether the comparison value of said comparison coefficient is greater than at least one of the comparison values of the three successors being closest to the spectral location of said comparison coefficient. The extrema determiner 410 may then decide whether to select said comparison coefficient depending on the result of said determinations.

In some embodiments, the comparison value of each spectral coefficient is a square value of a further coefficient of a further spectrum (a comparison spectrum) resulting from an energy preserving transformation of the audio signal.

In further embodiments, the comparison value of each spectral coefficient is an amplitude value of a further coefficient of a further spectrum resulting from an energy preserving transformation of the audio signal.

According to an embodiment, the further spectrum is a Discrete Fourier Transform spectrum and wherein the energy preserving transformation is a Discrete Fourier Transform.

According to a further embodiment, the further spectrum is a Complex Modified Discrete Cosine Transform (CMDCT) spectrum, and wherein the energy preserving transformation is a CMDCT.

In another embodiment, the extrema determiner 410 may not examine a comparison spectrum, but instead, may examine the audio signal input spectrum itself. This may, for example, be reasonable, when the audio signal input spectrum itself results from an energy preserving transformation, for example, when the audio signal input spectrum is a Discrete Fourier Transform magnitude spectrum.

For example, the extrema determiner 410 may be configured to determine the one or more extremum coefficients, so that each of the extremum coefficients is one of the spectral coefficients the spectral value of which is greater than the spectral value of one of its predecessors and the spectral value of which is greater than the spectral value of one of its successors.

In an embodiment, the extrema determiner 410 may be configured to determine the one or more extremum coefficients, so that each of the extremum coefficients is one of the spectral coefficients the spectral value of which is greater than the spectral value of its immediate predecessor and the spectral value of which is greater than the spectral value of its immediate successor.

Moreover, the apparatus comprises a spectrum modifier 420 for modifying the audio signal input spectrum to obtain a modified audio signal spectrum by setting the spectral value of the predecessor or the successor of at least one of the extremum coefficients to a predefined value. The spectrum modifier 420 is configured to not set the spectral values of the one or more extremum coefficients to the predefined value, or is configured to replace at least one of the one or more extremum coefficients by a pseudo coefficient, wherein the spectral value of the pseudo coefficient is different from the predefined value.

Advantageously, the predefined value may be zero. For example, in the modified (substituted) audio signal spectrum 530 of FIG. 8, the spectral values of a lot of spectral coefficients have been set to zero by the spectrum modifier 420.

In other words, to obtain the modified audio signal spectrum, the spectrum modifier 420 will set at least the spectral value of a predecessor or a successor of one of the extremum coefficients to a predefined value. The predefined value may e.g. be zero. The comparison value of such a predecessor or successor is smaller than the comparison value of said extremum value.

Moreover, regarding the extremum coefficients themselves, the spectrum modifier 420 will proceed as follows:

The spectrum modifier 420 will not set the extremum coefficients to the predefined value, or:

The spectrum modifier 420 will replace at least one of the extremum coefficients by a pseudo coefficient, wherein the spectral value of the pseudo coefficient is different from the predefined value. This means that the spectral value of at least one of the extremum coefficients is set to the predefined value, and the spectral value of another one of the spectral coefficients is set to a value which is different from the predefined value. Such a value may, for example, be derived from the spectral value of said extremum coefficient, of one of the predecessors of said extremum coefficient or of one of the successors of said extremum coefficient. Or, such a value may, for example, be derived from the comparison value of said extremum coefficient, of one of the predecessors of said extremum coefficient or of one of the successors of said extremum coefficient The spectrum modifier 420 may, for example, be configured to replace one of the extremum coefficients by a pseudo coefficient having a spectral value derived from the spectral value or the comparison value of said extremum coefficient, from the spectral value or the comparison value of one of the predecessors of said extremum coefficient or from the spectral value or the comparison value of one of the successors of said extremum coefficient.

Furthermore, the apparatus comprises a processing unit 430 for processing the modified audio signal spectrum to obtain an encoded audio signal spectrum.

For example, the processing unit 430 may be any kind of audio encoder, for example, an MP3 (MPEG-1 Audio Layer III or MPEG-2 Audio Layer III; MPEG=Moving Picture Experts Group) audio encoder, an audio encoder for WMA (Windows Media Audio), an audio encoder for WAVE-files or an MPEG-2/4 AAC (Advanced Audio Coding) audio encoder or an MPEG-D USAC (Unified Speed and Audio Coding) coder.

The processing unit 430 may, for example, be an audio encoder as described in [8] (ISO/IEC 14496-3:2005—Information technology—Coding of audio-visual objects—Part 3: Audio, Subpart 4) or as described in [9] (ISO/IEC 14496-3:2005—Information technology—Coding of audio-visual objects—Part 3: Audio, Subpart 4). For example, the processing unit 430 may comprise a quantizer, and/or a temporal noise shaping tool, as, for example, described in [8] and/or the processing unit 430 may comprise a perceptual noise substitution tool, as, for example, described in [8].

Moreover, the apparatus comprises a side information generator 440 for generating and transmitting side information. The side information generator 440 is configured to locate one or more pseudo coefficient candidates within the modified audio signal input spectrum generated by the spectrum modifier 420. Furthermore, the side information generator 440 is configured to select at least one of the pseudo coefficient candidates as selected candidates. Moreover, the side information generator 440 is configured to generate the side information so that the side information indicates the selected candidates as the pseudo coefficients.

In the embodiment illustrated by FIG. 7, the side information generator 440 is configured to receive the positions of the pseudo coefficients (e.g. the position of each of the pseudo coefficients) by the spectrum modifier 420. Moreover, in the embodiment of FIG. 7, the side information generator 440 is configured to receive the positions of the pseudo coefficient candidates (e.g. the position of each of the pseudo coefficient candidates).

For example, in some embodiments, the processing unit 430 may be configured to determine the pseudo coefficient candidates based on a quantized audio signal spectrum. In an embodiment, the processing unit 430 may have generated the quantized audio signal spectrum by quantizing the modified audio signal spectrum. For example, the processing unit 430 may determine the at least one spectral coefficient of the quantized audio signal spectrum as a pseudo coefficient candidate, which has an immediate predecessor, the spectral value of which is equal to the predefined value (e.g. equal to 0), and which has an immediate successor, the spectral value of which is equal to the predefined value.

Alternatively, in other embodiments, the processing unit 430 may pass the quantized audio signal spectrum to the side information generator 440 and the side information generator 440 may itself determine the pseudo coefficient candidates based on the quantized audio signal spectrum. According to other embodiments, the pseudo coefficient candidates are determined in an alternative way based on the modified audio signal spectrum.

The side information generated by the side information generator can be of a static, predefined size or its size can be estimated iteratively in a signal-adaptive manner. In this case, the actual size of the side information is transmitted to the decoder as well. So, according to an embodiment, the side information generator 440 is configured to transmit the size of the side information.

According to an embodiment, the extrema determiner 410 is configured to examine the comparison coefficients, for example, the coefficients of the power spectrum 520 in FIG. 8, and is configured to determine the one or more minimum coefficients, so that each of the minimum coefficients is one of the spectral coefficients the comparison value of which is smaller than the comparison value of one of its predecessors and the comparison value of which is smaller than the comparison value of one of its successors. In such an embodiment, the spectrum modifier 420 may be configured to determine a representation value based on the comparison values of one or more of the extremum coefficients and of one or more of the minimum coefficients, so that the representation value is different from the predefined value. Furthermore, the spectrum modifier 420 may be configured to change the spectral value of one of the coefficients of the audio signal input spectrum by setting said spectral value to the representation value.

In a specific embodiment, the extrema determiner is configured to examine the comparison coefficients, for example, the coefficients of the power spectrum 520 in FIG.

8, and is configured to determine the one or more minimum coefficients, so that each of the minimum coefficients is one of the spectral coefficients the comparison value of which is smaller than the comparison value of its immediate predecessor and the comparison value of which is smaller than the comparison value of its immediate successor.

Alternatively, the extrema determiner 410 is configured to examine the audio signal input spectrum 510 itself and is configured to determine one or more minimum coefficients, so that each of the one or more minimum coefficients is one of the spectral coefficients the spectral value of which is smaller than the spectral value of one of its predecessors and the spectral value of which is smaller than the spectral value of one of its successors. In such an embodiment, the spectrum modifier 420 may be configured to determine a representation value based on the spectral values of one or more of the extremum coefficients and of one or more of the minimum coefficients, so that the representation value is different from the predefined value. Moreover, the spectrum modifier 420 may be configured to change the spectral value of one of the coefficients of the audio signal input spectrum by setting said spectral value to the representation value.

In a specific embodiment, the extrema determiner 410 is configured to examine the audio signal input spectrum 510 itself and is configured to determine one or more minimum coefficients, so that each of the one or more minimum coefficients is one of the spectral coefficients the spectral value of which is smaller than the spectral value of its immediate predecessor and the spectral value of which is smaller than the spectral value of its immediate successor In both embodiments, the spectrum modifier 420 takes the extremum coefficient and one or more of the minimum coefficients into account, in particular their associated comparison values or their spectral values, to determine the representation value. Then, the spectral value of one of the spectral coefficients of the audio signal input spectrum is set to the representation value. For, the spectral coefficient, the spectral value of which is set to the representation value may, for example, be the extremum coefficient itself, or the spectral coefficient, the spectral value of which is set to the representation value may be the pseudo coefficient which replaces the extremum coefficient.

In an embodiment, the extrema determiner 410 may be configured to determine one or more sub-sequences of the sequence of spectral values, so that each one of the sub-sequences comprises a plurality of subsequent spectral coefficients of the audio signal input spectrum. The subsequent spectral coefficients are sequentially ordered within the sub-sequence according to their spectral position. Each of the sub-sequences has a first element being first in said sequentially-ordered sub-sequence and a last element being last in said sequentially-ordered sub-sequence.

In a specific embodiment, each of the sub-sequences may, for example, comprise exactly two of the minimum coefficients and exactly one of the extremum coefficients, one of the minimum coefficients being the first element of the sub-sequence, the other one of the minimum coefficients being the last element of the sub-sequence.

In an embodiment, the spectrum modifier 420 may be configured to determine the representation value based on the spectral values or the comparison values of the coefficients of one of the sub-sequences. For example, if the extrema determiner 410 has examined the comparison coefficients of the comparison spectrum, e.g. of the power spectrum 520, the spectrum modifier 420 may be configured to determine the representation value based on the comparison values of the coefficients of one of the sub-sequences. If, however, the extrema determiner 410 has examined the spectral coefficients of the audio signal input spectrum 510, the spectrum modifier 420 may be configured to determine the representation value based on the spectral values of the coefficients of one of the sub-sequences.

The spectrum modifier 420 is configured to change the spectral value of one of the coefficients of said sub-sequence by setting said spectral value to the representation value.

Table 2 provides an example with five spectral coefficients at the spectral locations 252 to 258.

TABLE 2

| | Spectral Location | | | | | | |
|---|---|---|---|---|---|---|---|
| | 252 | 253 | 254 | 255 | 256 | 257 | 258 |
| Comparison Value | 0.12 | 0.05 | 0.48 | 0.73 | 0.45 | 0.03 | 0.18 |

The extrema determiner 410 may determine that the spectral coefficient 255 (the spectral coefficient with the spectral location 255) is an extremum coefficient, as its comparison value (0.73) is greater than the comparison value (0.48) of its (here: immediate) predecessor 254, and as its comparison value (0.73) is greater than the comparison value (0.45) of its (here: immediate) successor 256.

Moreover, the extrema determiner 410 may determine that the spectral coefficient 253 (the is a minimum coefficient, as its comparison value (0.05) is smaller than the comparison value (0.12) of its (here: immediate) predecessor 252, and as its comparison value (0.05) is smaller than the comparison value (0.48) of its (here: immediate) successor 254.

Furthermore, the extrema determiner 410 may determine that the spectral coefficient 257 is a minimum coefficient as its comparison value (0.03) is smaller than the comparison value (0.45) of its (here: immediate) predecessor 256 and as its comparison value (0.03) is smaller than the comparison value (0.18) of its (here: immediate) successor 258.

The extrema determiner 410 may thus determine a sub-sequence comprising the spectral coefficients 253 to 257, by determining that spectral coefficient 255 is an extremum coefficient, by determining spectral coefficient 253 as the minimum coefficient being the closest preceding minimum coefficient to the extremum coefficient 255, and by determining spectral coefficient 257 as the minimum coefficient being the closest succeeding minimum coefficient to the extremum coefficient 255.

The spectrum modifier 420 may now determine a representation value for the sub-sequence 253-257 based on the comparison values of all the spectral coefficients 253-257.

For example, the spectrum modifier 420 may be configured to sum up the comparison values of all the spectral coefficients of the sub-sequence. (For example, for Table 2, the representation value for sub-sequence 253-257 then sums up to: 0.05+0.48+0.73+0.45+0.03=1.74).

Or, e.g., the spectrum modifier 420 may be configured to sum up the squares of the comparison values of all the spectral coefficients of the sub-sequence. (For example, for Table 2, the representation value for sub-sequence 253-257 then sums up to: $(0.05)^2+(0.48)^2+(0.73)^2+(0.45)^2+(0.03)^2=0.9692$).

Or, for example, the spectrum modifier 420 may be configured to square root the sum of the squares of the comparison values of all the spectral coefficients of the sub-sequence 253-257. (For example, for Table 2, the representation value is then 0.98448).

According to some embodiments, the spectrum modifier 420 will set the spectral value of the extremum coefficient (in Table to, the spectral value of spectral coefficient 253) to the predefined value.

Other embodiments, however, use a center-of-gravity approach. Table 3 illustrates a sub-sequence comprising the spectral coefficients 282-288:

TABLE 3

| | Spectral Location | | | | | | | | |
|---|---|---|---|---|---|---|---|---|---|
| | 281 | 282 | 283 | 284 | 285 | 286 | 287 | 288 | 289 |
| Comparison Value | 0.12 | 0.04 | 0.10 | 0.20 | 0.93 | 0.92 | 0.90 | 0.05 | 0.15 |

Although the extremum coefficient is located at spectral location 285, according to the center of gravity approach, the center-of-gravity is located at a different spectral location.

To determine the spectral location of the center-of-gravity, the extrema determiner 410 sums up weighted spectral locations of all spectral coefficients of the sub-sequence and divides the result by the sum of the comparison values of the spectral coefficients of the sub-sequence. Commercial rounding may then be employed on the result of the division to determine the center-of-gravity. The weighted spectral location of a spectral coefficient is the product of its spectral location and its comparison values.

In short: The extrema determiner may obtain the center-of-gravity by:

1) Determining the product of the comparison value and spectral location for each spectral coefficient of the sub-sequence.
2) Summing up the products determined in 1) to obtain a first sum
3) Summing up the comparison values of all spectral coefficients of the sub-sequence to obtain a second sum
4) Dividing the first sum by the second sum to generate an intermediate result; and
5) Apply round-to-nearest rounding on the intermediate result to obtain the center-of-gravity (round-to-nearest rounding: 8.49 is rounded to 8; 8.5 is rounded to 9)

Thus, for the example of Table 3, the center-of-gravity is obtained by:

$$(0.04\cdot 282+0.10\cdot 283+0.20\cdot 284+0.93\cdot 285+0.92\cdot 286+0.90\cdot 287+0.05\cdot 288)//(0.04+0.10+0.20+0.93+0.92+0.90+0.05)=897.25/3.14=285.75=286.$$

Thus, in the example of Table 3, the extrema determiner 410 would be configured to determine the spectral location 286 as the center-of-gravity.

In some embodiments, the extrema determiner 410 does not examine the complete comparison spectrum (e.g. the power spectrum 520) or does not examine the complete audio signal input spectrum. Instead, the extrema determiner 410 may only partially examine the comparison spectrum or the audio signal input spectrum.

Figure 9:
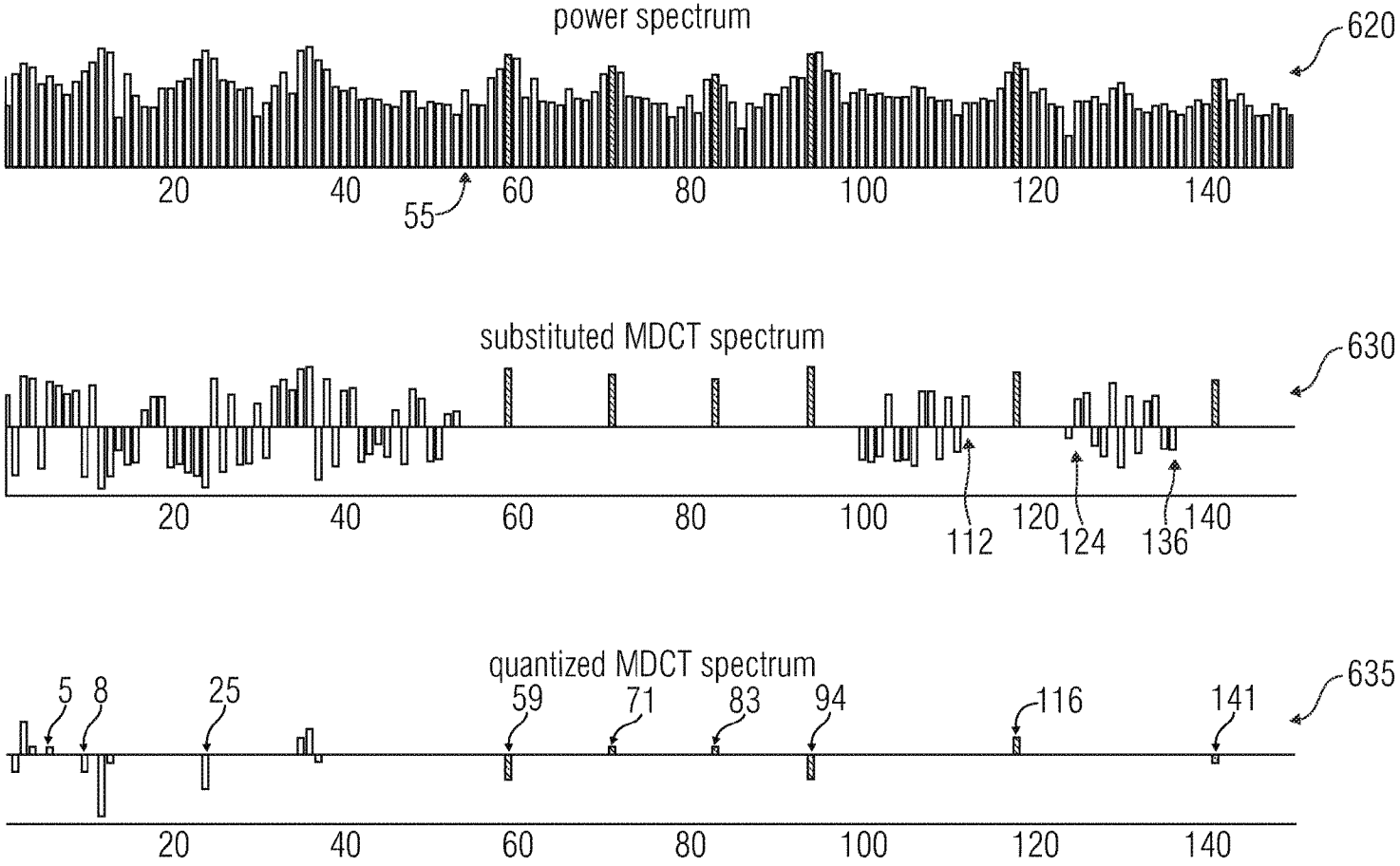
FIG. 9 illustrates another power spectrum, another modified (substituted) audio signal spectrum, and a quantized audio signal spectrum, wherein the quantized audio signal spectrum generated at an encoder side, may, in some embodiments, correspond to the decoded audio signal spectrum decoded at a decoding side.

FIG. 9 illustrates such an example. There, the power spectrum 620 (as a comparison spectrum) has been examined by an extrema determiner 410 starting at coefficient 55. The coefficients at spectral locations smaller than 55 have not been examined. Therefore, spectral coefficients at spectral locations smaller than 55 remain unmodified in the substituted MDCT spectrum 630. In contrast FIG. 8 illustrates a substituted MDCT spectrum 530 where all MDCT spectral lines have been modified by the spectrum modifier 420.

Thus, the spectrum modifier 420 may be configured to modify the audio signal input spectrum so that the spectral values of at least some of the spectral coefficients of the audio signal input spectrum are left unmodified.

In some embodiments, the spectrum modifier 420 is configured to determine, whether a value difference between one of the comparison value or the spectral value of one of the extremum coefficients is smaller than a threshold value. In such embodiments, the spectrum modifier 420 is configured to modify the audio signal input spectrum so that the spectral values of at least some of the spectral coefficients of the audio signal input spectrum are left unmodified in the modified audios signal spectrum depending on whether the value difference is smaller than the threshold value.

For example, in an embodiment, the spectrum modifier 420 may be configured not to modify or replace all, but instead modify or replace only some of the extremum coefficients. For example, when the difference between the comparison value of the extremum coefficient (e.g. a local maximum) and the comparison value of the subsequent and/or preceding minimum value is smaller than a threshold value, the spectrum modifier may be determined not to modify these spectral values (and e.g. the spectral values of spectral coefficients between them), but instead leave these spectral values unmodified in the modified (substituted) MDCT spectrum 630. In the modified MDCT spectrum 630 of FIG. 9, the spectral values of the spectral coefficients 100 to 112 and the spectral values of the spectral coefficients 124 to 136 have been left unmodified by the spectral modifier in the unmodified (substituted) spectrum 630.

The processing unit may furthermore be configured to quantize coefficients of the modified (substituted) MDCT spectrum 630 to obtain a quantized MDCT spectrum 635.

According to an embodiment, the spectrum modifier 420 may be configured to receive fine-tuning information. The spectral values of the spectral coefficients of the audio signal input spectrum may be signed values, each comprising a sign component. The spectrum modifier may be configured to set the sign component of one of the one or more extremum coefficients or of the pseudo coefficient to a first sign value, when the fine-tuning information is in a first fine-tuning state. And the spectrum modifier may be configured to set the sign component of the spectral value of one of the one or more extremum coefficients or of the pseudo coefficient to a different second sign value, when the fine-tuning information is in a different second fine-tuning state.

For example, in Table 4.

TABLE 4

| | Spectral Location | | | | | | | | |
|---|---|---|---|---|---|---|---|---|---|
| | 291 | 301 | 321 | 329 | 342 | 362 | 388 | 397 | 405 |
| Spectral Value | +0.88 | −0.91 | +0.79 | −0.82 | +0.93 | −0.92 | −0.90 | +0.95 | −0.92 |
| Fine-tuning state | 1st | 2nd | 1st | 2nd | 1st | 2nd | 2nd | 1st | 2nd |

the spectral values of the spectral coefficients indicate that spectral coefficient 291 is in a first fine-tuning state, spectral coefficient 301 is in a second fine-tuning state, spectral coefficient 321 is in the first fine-tuning state, etc.

For example, returning to the center-of-gravity determination explained above, if the center of gravity is (e.g. approximately in the middle) between two spectral locations, the spectral modifier may set the sign so that the second fine-tuning state is indicated.

According to an embodiment, the processing unit 430 may be configured to quantize the modified audio signal spectrum to obtain a quantized audio signal spectrum. The processing unit 430 may furthermore be configured to process the quantized audio signal spectrum to obtain an encoded audio signal spectrum.

Moreover, the processing unit 430 may furthermore be configured to generate side information indicating only for those spectral coefficients of the quantized audio signal spectrum which have an immediate predecessor the spectral value of which is equal to the predefined value and an immediate successor, the spectral value of which is equal to the predefined value, whether a said coefficient is one of the extremum coefficients.

Such information can be provided by the extrema determiner 410 to the processing unit 430.

For example, such an information may be stored by the processing unit 430 in a bit field, indicating for each of the spectral coefficients of the quantized audio signal spectrum which has an immediate predecessor the spectral value of which is equal to the predefined value and an immediate successor, the spectral value of which is equal to the predefined value, whether said coefficient is one of the extremum coefficients (e.g. by a bit value 1) or whether said coefficient is not one of the extremum coefficients (e.g. by a bit value 0). In an embodiment, a decoder can later on use this information for restoring the audio signal input spectrum. The bit field may have a fixed length or a signal adaptively chosen length. In the latter case, the length of the bit field might be additionally conveyed to the decoder.

For example, a bit field [000111111] generated by the processing unit 430 might indicate, that the first three "stand-alone" coefficients (their spectral value is not equal to the predefined value, but the spectral values of their predecessor and of their successor are equal to the predefined value) that appear in the (sequentially ordered) (quantized) audio signal spectrum are not extremum coefficients, but the next six "stand-alone" coefficients are extremum coefficients. This bit field describes the situation that can be seen in the quantized MDCT spectrum 635 in FIG. 9, where the first three "stand-alone" coefficients 5, 8, 25 are not extremum coefficients, but where the next six "stand-alone" coefficients 59, 71, 83, 94, 116, 141 are extremum coefficients.

Again, the immediate predecessor of said spectral coefficient is another spectral coefficient which immediately precedes said spectral coefficient within the quantized audio signal spectrum, and the immediate successor of said spectral coefficient is another spectral coefficient which immediately succeeds said spectral coefficient within the quantized audio signal spectrum.

The proposed concepts enhance the perceptual quality of conventional block based transform codecs at low bit rates. It is proposed to substitute local tonal regions in audio signal spectra, spanning neighbouring local minima, encompassing a local maximum, by pseudo-lines (also referred to as pseudo coefficients) having, in some embodiments, a similar energy or level as said regions to be substituted.

At low bit rates, embodiments provide concepts how to tightly integrate waveform coding and parametric coding to obtain an improved perceptual quality and an improved scaling of perceptual quality versus bit rate over the single techniques.

In some embodiments, peaky areas (spanning neighbouring local minima, encompassing a local maximum) of spectra may be fully substituted by a single sinusoid each; as opposed to sinusoidal coders which iteratively subtract synthesized sinusoids from the residual. Suitable peaky areas are extracted on a smoothed and slightly whitened spectral representation and are selected with respect to certain features (peak height, peak shape).

According to some embodiments, these substitution sinusoids may be represented as pseudo-lines (pseudo coefficients) within the spectrum to be coded and reflect the full amplitude or energy of the sinusoid (as opposed, e.g. regular MDCT lines correspond to the real projection of the true value).

According to some embodiments, pseudo-lines (pseudo coefficients) may be marked as such by side info flag array.

In some embodiments, the choice of sign of the pseudo-lines may denote semi subband frequency resolution.

According to some embodiments, a lower cut-off frequency for sinusoidal substitution may be advisable due to the limited frequency resolution (e.g. semi-subband).

In the following, concepts are provided for generating an audio output signal based on an encoded audio signal. These concepts implement an efficient synthesis of sinusoids and sweeps in the MDCT domain.

Figure 1A:
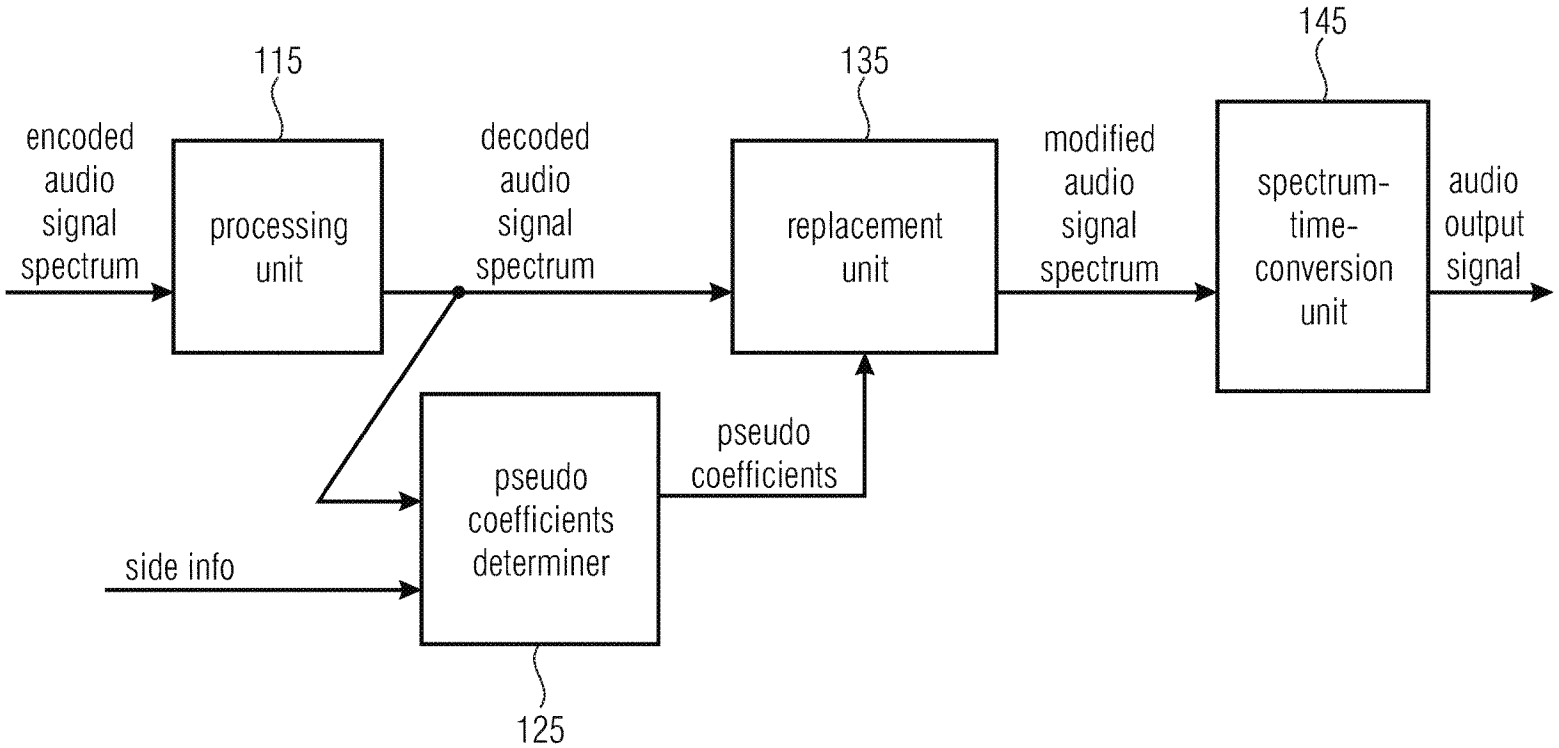
FIG. 1*a* illustrates an apparatus for generating an audio output signal based on an encoded audio signal spectrum according to an embodiment.

FIG. 1*a* illustrates an apparatus for generating an audio output signal based on an encoded audio signal spectrum according to an embodiment.

The apparatus comprises a processing unit 115 for processing the encoded audio signal spectrum to obtain a decoded audio signal spectrum comprising a plurality of spectral coefficients, wherein each of the spectral coefficients has a spectral location within the encoded audio signal spectrum and a spectral value, wherein the spectral coefficients are sequentially ordered according to their spectral location within the encoded audio signal spectrum so that the spectral coefficients form a sequence of spectral coefficients.

Moreover, the apparatus comprises a pseudo coefficients determiner 125 for determining one or more pseudo coefficients of the decoded audio signal spectrum, wherein each of the pseudo coefficients is one of the spectral coefficients (as each of the pseudo coefficients is one of the spectral coefficients, each of the pseudo coefficients has a spectral location and a spectral value).

Furthermore, the apparatus comprises a replacement unit 135 for replacing at least one or more pseudo coefficients by a determined spectral pattern to obtain a modified audio signal spectrum, wherein the determined spectral pattern comprises at least two pattern coefficients, wherein each of the at least two pattern coefficients has a spectral value.

For example, in some embodiments, the replacement unit 135 may obtain a spectral pattern as an obtained spectral pattern from a storage unit, wherein the storage unit is comprised by the apparatus, and wherein the storage unit comprises a database or a memory. In other embodiments, the replacement unit 135 may obtain a spectral pattern from a remote unit, for example, a remote database, e.g. located far away from the apparatus. In further embodiments, the pattern will be generated analytically on-the-fly (at runtime, when needed). The obtained spectral pattern may then be employed as the determined spectral pattern. Or, the determined spectral pattern may be derived from the obtained spectral pattern, e.g. by modifying the obtained spectral pattern.

Moreover, the apparatus comprises a spectrum-time-conversion unit 145 for converting the modified audio signal spectrum to a time-domain to obtain the audio output signal.

Figure 1B:
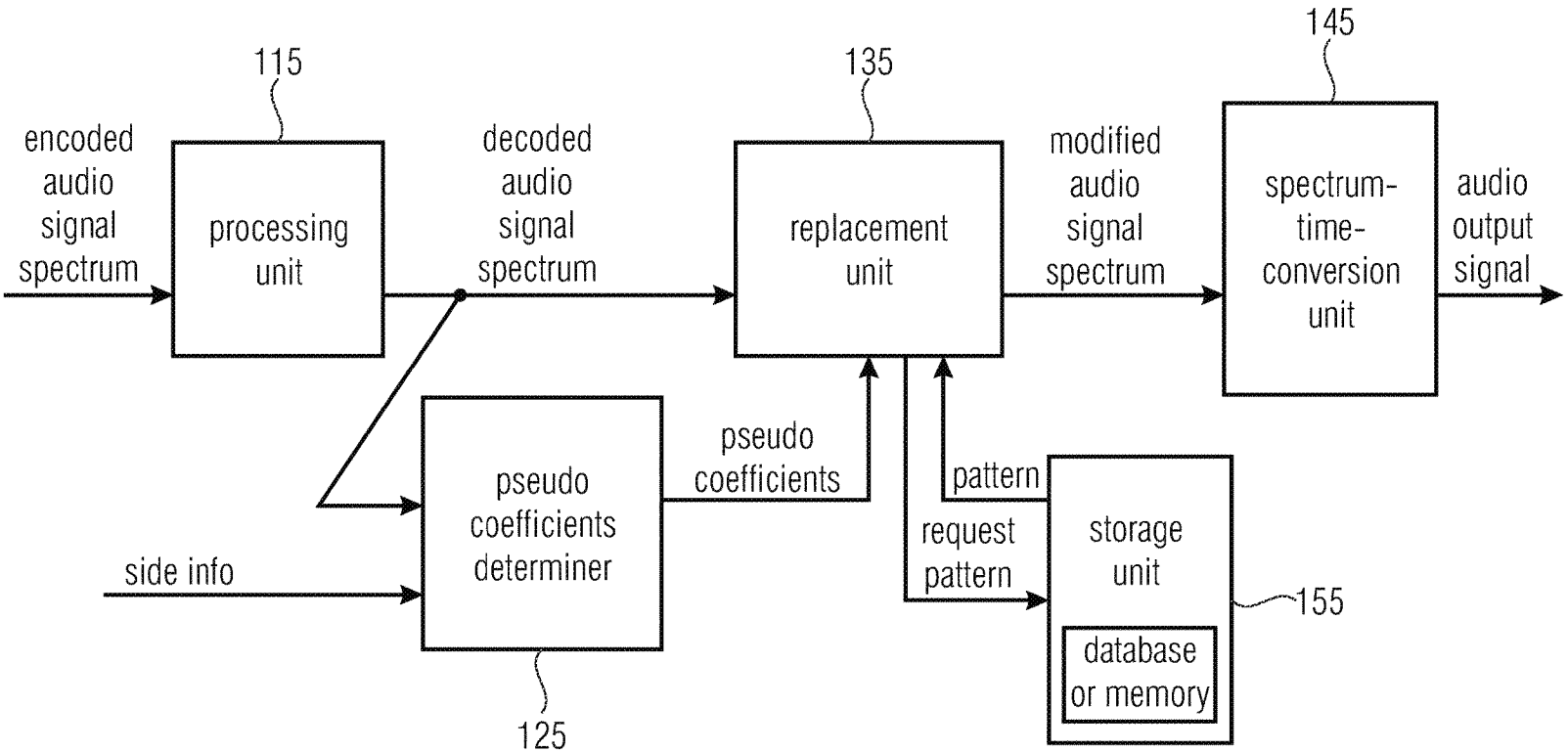
FIG. 1*b* illustrates an apparatus for generating an audio output signal based on an encoded audio signal spectrum according to another embodiment.

FIG. 1*b* illustrates an apparatus for generating an audio output signal based on an encoded audio signal spectrum according to another embodiment. The apparatus of FIG. 1*b* differs from the apparatus of the embodiment of FIG. 1*a* in that it further comprises a storage unit 155 which itself comprises a database or a memory.

In particular, the apparatus of the embodiment of FIG. 1*b* furthermore comprises a storage unit 155 comprising a database or a memory having stored within the database or within the memory a plurality of stored spectral patterns. Each of the stored spectral patterns has a spectral property (e.g. constant frequency, sweeping frequency—each in an on-bin or a between-bin location version—etc.). The replacement unit 135 is configured to request one of the stored spectral patterns as a requested spectral pattern from the storage unit 155. The storage unit 155 is configured to provide said requested spectral pattern. Moreover, the replacement unit 135 is configured to replace the at least one or more pseudo coefficients by the determined spectral pattern based on the requested spectral pattern.

In embodiments, the stored spectral patterns have not been stored for specific frequencies. This would necessitate massive amounts of memory. Thus each pattern (e.g. a constant on-bin pattern, a constant between-bin pattern and some patterns for various sweeps) is stored only once. This general pattern is then requested from e.g. a database, adapted to the target frequency, e.g. to a target frequency 8200 Hz, adapted to the necessitated phase (e.g. 0 rad), and then patched at the target spectral location.

In an embodiment, the replacement unit 135 is configured to request one of the stored spectral patterns from the storage unit 155 depending on a first derived spectral location derived from at least one of the one or more pseudo coefficients determined by the pseudo coefficients determiner 125. E.g., the request depends on the nature of the pattern (constant, sweep, etc.) and the pattern adaption depends on the spectral location and the predeccessor within a sinusoidal track or a signal adaptively determined start phase of a sinusoidal track.

In one embodiment, the first derived spectral location derived from at least one of the one or more pseudo coefficients may be the spectral location of one of the pseudo coefficients.

In another embodiment, the one or more pseudo coefficients are signed values, each comprising a sign component, and the replacement unit 135 is configured to determine the first derived spectral location based on the spectral location of one pseudo coefficient of the one or more pseudo coefficients and based on the sign component of said pseudo coefficient, so that the first derived spectral location is equal to the spectral location of said pseudo coefficient when the sign component has a first sign value, and so that the first derived spectral location is equal to a modified location, the modified location resulting from shifting the spectral location of said pseudo coefficient by a predefined value when the sign component has a different second value.

For example, a half-bin frequency resolution of the pseudo-lines can be signalled by the sign of said pseudo coefficient. The predefined value by which the spectral location of said pseudo coefficient is shifted may then correspond to half of the frequency difference, e.g. of two subsequent bins, for example, when a time-frequency domain is considered, when the sign component of the pseudo coefficient has the second sign value.

In a specific embodiment, the pseudo coefficients 125 determiner is configured to determine two or more temporally consecutive pseudo coefficients of the decoded audio signal spectrum. The replacement unit 135 is configured to assign a first pseudo coefficient and a second pseudo coefficient of the two or more temporally consecutive pseudo coefficients to a track depending on whether an absolute difference between the first derived spectral location derived from the first pseudo coefficient and a second derived spectral location derived from the second pseudo coefficient is smaller than a threshold value. The plurality of stored spectral patterns being stored within the database or the memory of the storage unit may be either stationary tone patterns or frequency sweep patterns. The replacement unit 135 may then be configured to request one of the stationary tone patterns from the storage unit 155 when the first derived spectral location derived from the first pseudo coefficient of the track is equal to the second derived spectral location derived from the second pseudo coefficient of the track. Furthermore, the replacement unit 135 may be configured to request one of the frequency sweep patterns from the storage unit 155 when the first derived spectral location derived from the first pseudo coefficient of the track is different from the second derived spectral location derived from the second pseudo coefficient of the track.

For example, the first derived spectral location derived from the first pseudo coefficient of the track may be the spectral location of the first pseudo coefficient. E.g. the second derived spectral location derived from the second pseudo coefficient of the track may be the spectral location of the second pseudo coefficient.

For example, a pseudo coefficient may be assigned to one of a plurality of time-frequency bins or to an intermediate frequency location between two time-frequency bins, for example, to the time-frequency bin (n, k), wherein n denotes time, and wherein k denotes frequency. The frequency of the time-frequency bin of the pseudo coefficient or the frequency location between the two time-frequency bins may then indicate the spectral location of the pseudo coefficient. When receiving the time-frequency bin (n, k) the replacement unit 135 will check, whether it already received a pseudo coefficient being assigned to a time-frequency bin which immediately precedes the time-frequency bin of the current pseudo coefficient in time (n−1) and which is equal to or close to the frequency of the time-frequency bin of the current pseudo coefficient (equal to or close to k). The replacement unit 135 will then assign both pseudo coefficients to a track.

E.g., pseudo coefficient having a time-frequency bin which immediately precedes the current time-frequency bin in time might be considered close to the frequency of the current time-frequency bin, if the absolute difference of the frequencies of both frequencies is smaller than a threshold value. (For example, if frequency indices are considered as frequencies, if the absolute difference is smaller than 2).

If both pseudo coefficients of the track have the same spectral location, the replacement unit 135 regards this as an indication that a stationary tone is present and requests a stationary tone pattern having the corresponding frequency.

However, if the spectral locations of the spectral coefficients of a track differ, the replacement unit 135 regards this as an indication that a sweep is present and requests a frequency sweep pattern from the storage unit 155. The frequency indicated by the frequency location of the preceding pseudo coefficient within the track may then indicate a start frequency of the sweep pattern and the frequency indicated by the frequency location of the current pseudo coefficient within the track may then indicate a target frequency of the sweep pattern.

According to an embodiment, the replacement unit 135 may be configured to request a first frequency sweep pattern of the frequency sweep patterns from the storage unit when a frequency difference between the second pseudo coefficient of the track and the first pseudo coefficient of the track is equal to half of a predefined value.

Moreover, the replacement unit 135 may be configured to request a second frequency sweep pattern, being different from the first frequency sweep pattern, of the frequency sweep patterns from the storage unit when the frequency difference between the second pseudo coefficient of the track and the first pseudo coefficient of the track is equal to the predefined value.

Furthermore, the replacement unit 135 may be configured to request a third frequency sweep pattern, being different from the first sweep pattern and the second frequency sweep pattern, of the frequency sweep patterns from the storage unit when the frequency difference between the second pseudo coefficient of the track and the first pseudo coefficient of the track is equal to one and a half times the predefined value.

For example, the predefined value may be a frequency difference between two temporally subsequent time-frequency bins. Thus in such an embodiment, patterns for sweeps are provided where the frequency difference between a start frequency and a target frequency differs by ½ frequency bin difference, by a 1.0 frequency bin difference and by a 3/2 frequency bin difference.

Figure 1C:
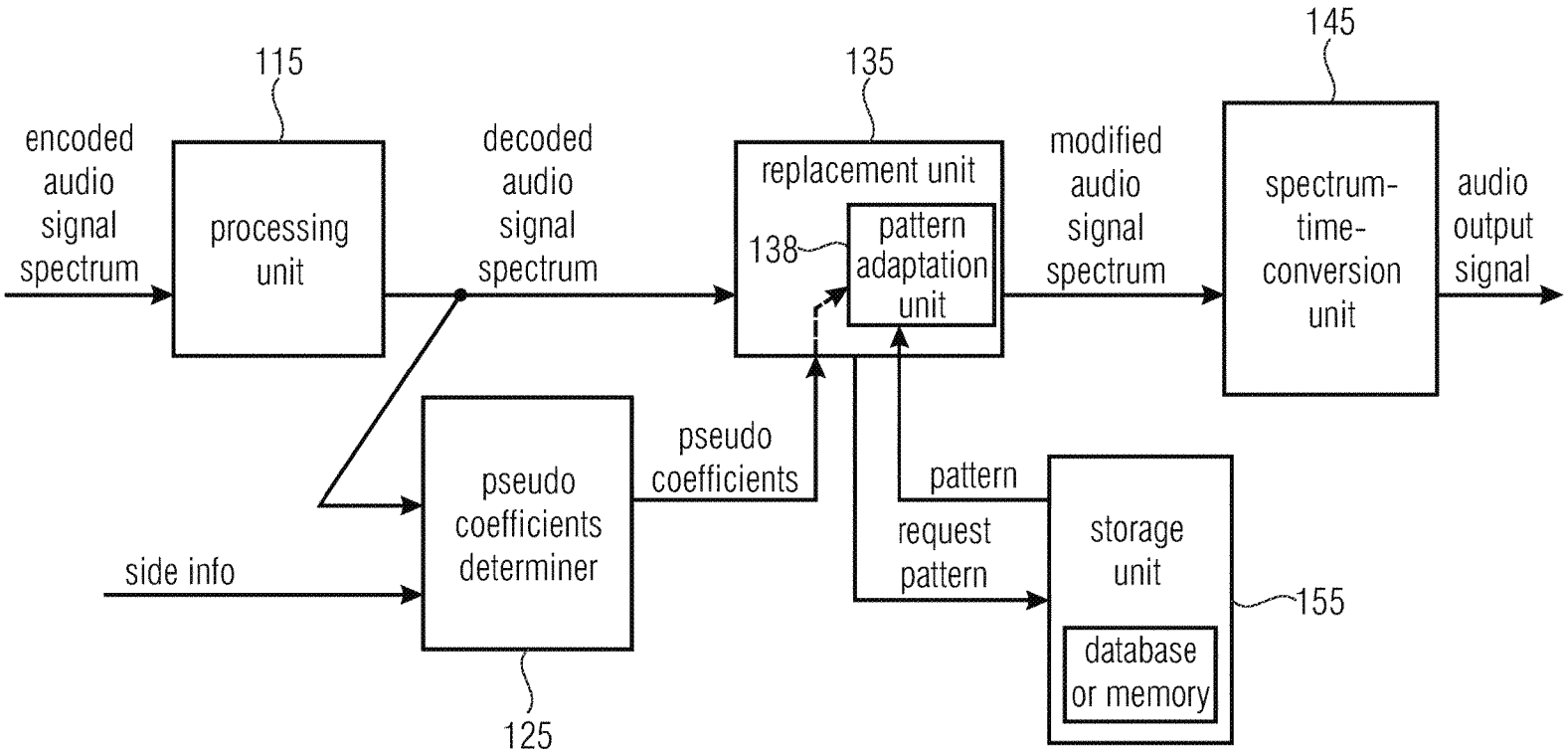
FIG. 1*c* illustrates an apparatus for generating an audio output signal based on an encoded audio signal spectrum according to a further embodiment.

FIG. 1*c* illustrates an apparatus according to an embodiment, where the replacement unit 135 comprises a pattern adaptation unit 138 being configured to modify the requested spectral pattern provided by the storage unit 155 to obtain the determined spectral pattern.

In an embodiment, the pattern adaptation unit 138 may be configured to modify the requested spectral pattern provided by the storage unit 155 by resealing the spectral values of the pattern coefficients of the requested spectral pattern depending on the spectral value of one of the one or more pseudo coefficients to obtain a determined spectral pattern. The spectral replacement unit 135 is then configured to replace at least one or more pseudo coefficients by the determined spectral pattern to obtain the modified audio signal spectrum. Thus, according this embodiment, the size of the spectral values of the pattern coefficients of the requested spectral pattern can be adjusted depending on the spectral value of the pseudo coefficient.

According to an embodiment, the pattern adaptation unit 138 may be configured to modify the requested spectral pattern provided by the storage unit depending on a start phase so that the spectral value of each of the pattern coefficients of the requested spectral pattern is modified in a first way, when the start phase has a first start phase value, and so that the spectral value of each of the pattern coefficients of the requested spectral pattern is modified in a different second way, when the start phase has a different second start phase value. By adjusting the phase of the patterns of a track seamless transition from one pattern of a track to the following pattern can be achieved.

According to an embodiment, the spectral value of each of the pattern coefficients of the requested spectral pattern is a complex coefficient comprising a real part and an imaginary part. The pattern adaptation unit 138 may be configured to modify the requested spectral pattern by modifying the real part and the imaginary part of each of the pattern coefficients of the requested spectral pattern provided by the storage unit 155, so that for each of the complex coefficients a vector representing said complex coefficient in a complex plane is rotated by the same angle for each of the complex coefficients. Alternatively, the phase of a stored pattern may be rotated by application of a complex rotation factor $e^{j\cdot\Phi}$, with $\phi$ being an arbitrary phase angle.

In a particular embodiment, the spectral value of each of the pattern coefficients of the requested spectral pattern comprises a real part and an imaginary part. In such an embodiment, the pattern adaptation unit 138 may be configured to modify the requested spectral pattern provided by the storage unit 155 by negating the real and the imaginary part of the spectral value of each of the pattern coefficients of the requested spectral pattern, or by swapping the real part or a negated real part and the imaginary part or a negated imaginary part of the spectral value of each of the pattern coefficients of the requested spectral pattern.

In an embodiment, the pattern adaptation unit 138 may be configured to modify the requested spectral pattern provided by the storage unit 155 by realizing a temporal mirroring of the pattern. Typically, this can be obtained in a frequency domain by computing the complex conjugate (by multiplication of the imaginary part by −1) of the pattern and applying a complex phase term (twiddle).

According to an embodiment, the decoded audio signal spectrum is represented in an MDCT domain. In such an embodiment, the pattern adaptation unit 138 is then configured to modify the requested spectral pattern provided by the storage unit 155 by modifying the spectral values of the pattern coefficients of the requested spectral pattern to obtain a modified spectral pattern, wherein the spectral values are represented in an Oddly-Stacked Discrete Fourier Transform domain. Furthermore, the pattern adaptation unit 138 is in such an embodiment configured to transform the spectral values of the pattern coefficients of the modified spectral pattern from the Oddly-Stacked Discrete Fourier Transform domain to the MDCT domain to obtain the determined spectral pattern. Moreover, the replacement unit 135 is in such an embodiment configured to replace the at least one or more pseudo coefficients by the determined spectral pattern being represented in the MDCT domain to obtain the modified audio signal spectrum being represented in the MDCT domain.

Alternatively, in embodiments the spectral values may be represented in a Complex Modified Discrete Cosine Transform (CMDCT) domain. Furthermore, in these embodiments the pattern adaptation unit 138 may be configured to transform the spectral values of the pattern coefficients of the modified spectral pattern from the CMDCT domain to the MDCT domain to obtain the determined spectral pattern by simply extracting the real part of the complex modified pattern.

Figure 1D:
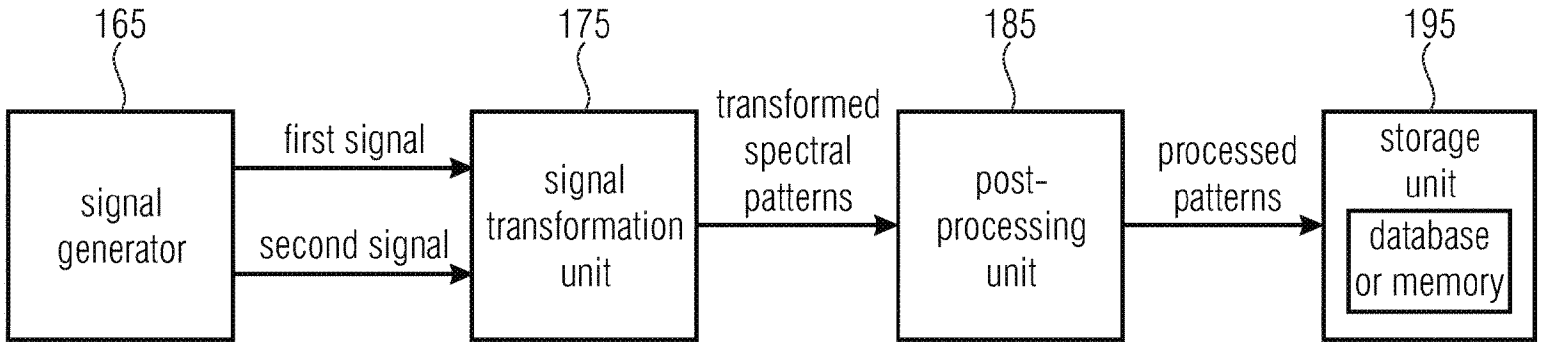
FIG. 1*d* illustrates an apparatus for generating a plurality of spectral patterns according to an embodiment.

FIG. 1*d* illustrates an apparatus for generating a plurality of spectral patterns according to an embodiment.

The apparatus comprises a signal generator 165 for generating a plurality of signals in a first domain.

Furthermore, the apparatus comprises a signal transformation unit 175 for transforming each signal of the plurality of signals from the first domain to a second domain to obtain a plurality of spectral patterns, each pattern of the plurality of transformed spectral patterns comprising a plurality of coefficients.

Moreover, the apparatus comprises a postprocessing unit 185 for truncating the transformed spectral patterns by removing one or more of the coefficients of the transformed spectral patterns to obtain a plurality of processed patterns.

Furthermore, the apparatus comprises a storage unit 195 comprising a database or a memory, wherein the storage unit 195 is configured to store each processed pattern of the plurality of processed patterns in the database or the memory.

The signal generator 165 is configured to generate each signal of the plurality of signals based on the formulae $$x(t)=\cos(2\pi\phi(t))$$

and $$\phi(t)=\phi(0)+\int_0^t 2\pi f(\tau)d\tau,$$

wherein t and $\tau$ indicate time, wherein $\phi(t)$ is an instantaneous phase at t, and wherein $f(\tau)$ is an instantaneous frequency at $\tau$, wherein each signal of the plurality of signals has a start frequency ($f_0$), being an instantaneous frequency of said signal at a first point-in-time, and a target frequency ($f_1$), being an instantaneous frequency of said signal at a different second point-in-time.

The signal generator 165 is configured to generate a first signal of the plurality of signals so that the target frequency ($f_1$) of the first signal is equal to the start frequency ($f_0$). Moreover, the signal generator 165 is configured to generate a different second signal of the plurality of signals so that the target frequency ($f_1$) of the first signal is different from the start frequency ($f_0$).

According to an embodiment, the signal transformation unit 175 is configured to transform each signal of the plurality of signals from the first domain, being a time domain, to a second domain, being a spectral domain. The signal transformation unit 175 is configured to generate a first one of a plurality of time blocks for transforming said signal, wherein each time block of the plurality of time blocks comprises a plurality of weighted samples, wherein each of said weighted samples is a signal sample of said signal being weighted by a weight of a plurality of weights, wherein the plurality of weights are assigned to said time block, and wherein each weight of the plurality of weights is assigned to a point-in-time. The start frequency ($f_0$) of each signal of the plurality of signals is an instantaneous frequency of said signal at the first point-in-time, where a first one of the weights of the first one of the time blocks is assigned to the first point-in-time, where a second one of the weights of a different second one of the time blocks is assigned to the first point-in-time, wherein the first one of the time blocks and the second one of the time blocks overlap, and wherein the first one of the weights is equal to the second one of the weights. The target frequency ($f_1$) of each signal of the plurality of signals is an instantaneous frequency of said signal at the second point-in-time, where a third one of the weights of the first one of the time blocks is assigned to the second point-in-time, where a fourth one of the weights of a different third one of the time blocks is assigned to the second point-in-time, wherein the first one of the time blocks and the third one of the time blocks overlap, and wherein the third one of the weights is equal to the fourth one of the weights.

Figure 6A:
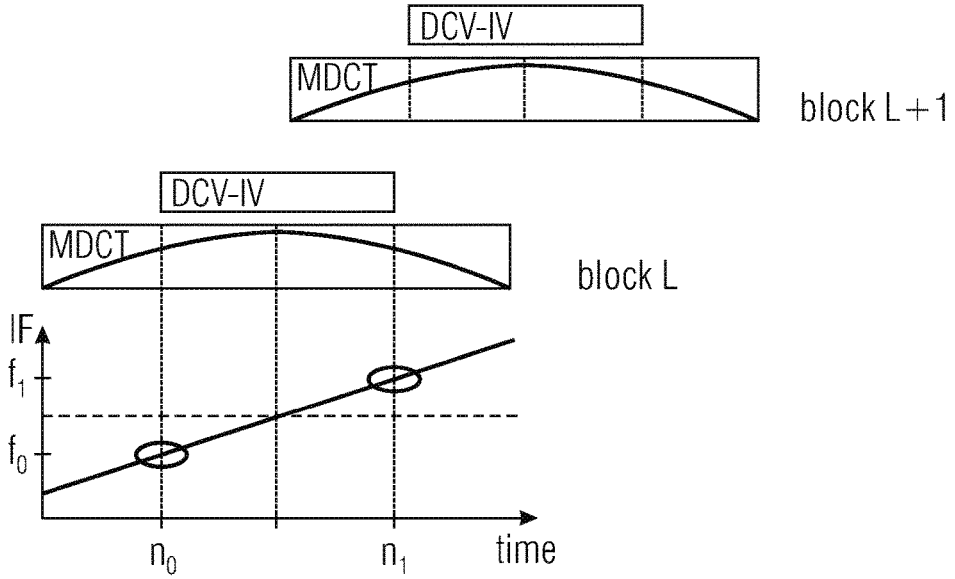
FIG. 6*a* shows an instantaneous frequency of a sinusoidal sweep at points in time for overlapping blocks according to embodiments.

E.g., FIG. 6*a* illustrates an example, wherein, the first point-in-time is indicated by $n_0$ and the second point-in-time is indicated by $n_1$. The overlapping blocks are illustrated by blocks L and L+1. The weights are depicted by the curve in block L and the curve in block L+1, respectively.

It should be noted that it is e.g. sufficient to generate only one time block (e.g. the first one of the time blocks) for the generation of a pattern.

According to an embodiment, each signal of the plurality of signals has a start phase ($\phi_0$), being a phase of said signal at a first point-in-time, and a target phase ($\phi_1$), being a phase of said signal at a different second point-in-time, wherein the signal generator (165) is configured to generate the plurality of signals such that the start phase ($\phi_0$) of a first one of the plurality signals is equal to the start phase ($\phi_0$) of a different second one of the plurality of the signals.

The start phase (and, implicitly by choice of start and stop frequency, the target (stop) phase) of each signal of the plurality of signals is adjusted at said start and stop points-in-time.

By this special choice of first (start) and second (stop) points-in-time, overlap-add artifacts are reduced that may occur, if patterns with different spectral properties are chained.

In an embodiment, the postprocessing unit 185 may be furthermore configured to conduct a rotation by $\pi/4$ on the spectral coefficients of each of the transformed spectral patterns to obtain a plurality of rotated spectral patterns.

According to a further embodiment, the signal generator 165 may be configured to generate the first signal, the second signal and one or more further signals as the plurality of signals, so that each difference of the target frequency and the start frequency of each of the further signals is an integer multiple of a difference of the target frequency and the start frequency of the second signal.

For example, the frequency difference of the target frequency and the start frequency of the second signal may correspond to a half bin frequency difference, e.g. a frequency difference of half of the frequency difference of two subsequent bins when time-frequency bins are considered. The frequency difference of the target frequency and the start frequency of a further third signal may correspond to a one bin frequency difference, e.g. a frequency difference corresponding to the frequency difference of two subsequent bins when time-frequency bins are considered. The frequency difference of the target frequency and the start frequency of a further fourth signal may correspond to a one-and-a-half bin frequency difference, e.g. a frequency difference corresponding to one-and-a-half of the frequency difference of two subsequent bins when time-frequency bins are considered.

Thus, the ratio of the difference of the target frequency and the start frequency of the third signal to the difference of the target frequency and the start frequency of the second signal is 2.0 (an integer value). The ratio of the difference of the target frequency and the start frequency of the fourth signal to the difference of the target frequency and the start frequency of the second signal is 3.0 (an integer value).

Before providing descriptions of specific embodiments in more detail, for better explanation, the MDCT basics are described.

The MDCT of a real signal x(n) is defined for signal segments windowed with w(n) at time l, that is $w_a(l, n)\cdot x(l, n)\in\mathbb{R}$, of length N as follows:

$$\begin{aligned} X_{MDCT}(l, m) &= MDCT\{w_a(l, n)\cdot x(l, n)\} \\ &= \sqrt{\frac{2}{M}}\sum_{n=0}^{N-1} w_a(l, n)\cdot \\ &\quad x(l, n)\cos\left(\frac{\pi}{M}\left(m+\frac{1}{2}\right)\left(n+\frac{1}{2}+\frac{M}{2}\right)\right), \end{aligned} \tag{1}$$

$$M=\frac{N}{2},\ m\in\{0, 1, \ldots, M-1\},$$

The +½ in (m+½) represents the frequency shift. The (n+½+M/2) represents the time shift.

The inverse transform is written as $$\tilde{x}(l, n) = MDCT^{-1}\{X(l, m)\} = w_s(l, n)\sqrt{\frac{2}{M}}\sum_{m=0}^{M-1} X(l, m)\cos\left(\frac{\pi}{M}\left(m+\frac{1}{2}\right)\left(n+\frac{1}{2}+\frac{M}{2}\right)\right), \quad N = 2M, n \in \{0, 1, \ldots, N-1\}. \tag{2}$$

The MDCT can be seen as the real part of the Complex Modified Discrete Cosine Transform (CMDCT) which is defined as $$X_{CMDCT}(l, m) = CMDCT\{w_a(l, n)\cdot x(l, n)\} = \sqrt{\frac{2}{M}}\sum_{n=0}^{N-1} w_a(l, n)\cdot x(l, n)\cos\left(\frac{\pi}{M}\left(m+\frac{1}{2}\right)\left(n+\frac{1}{2}+\frac{M}{2}\right)\right) - j\sqrt{\frac{2}{M}}\sum_{n=0}^{N-1} w_a(l, n)\cdot x(l, n)\sin\left(\frac{\pi}{M}\left(m+\frac{1}{2}\right)\left(n+\frac{1}{2}+\frac{M}{2}\right)\right), \quad M = \frac{N}{2}, m \in \{0, 1, \ldots, M-1\}. \tag{3}$$

Moreover, the CMDCT can be expressed as an Oddly-Stacked Discrete Fourier Transform (ODFT) or Discrete Fourier Transform (DFT) and exponential pre- and post-twiddling phase terms $$X_{CMDCT}(l, m) = CMDCT\{w_a(l, n)\cdot x(l, n)\} = ODFT\{w_a(l, n)\cdot x(l, n)\}\cdot e^{-j\frac{\pi}{M}(m+\frac{1}{2})(\frac{1}{2}+\frac{M}{2})} = DFT\left\{w_a(l, n)\cdot x(l, n)\cdot e^{-j\frac{\pi}{2M}n}\right\}\cdot e^{-j\frac{\pi}{M}(m+\frac{1}{2})(\frac{1}{2}+\frac{M}{2})}, \quad M = \frac{N}{2}, m \in \{0, 1, \ldots, M-1\}. \tag{4}$$

The $$e^{-j\frac{\pi}{M}(m+\frac{1}{2})(\frac{1}{2}+\frac{M}{2})}$$

represents the time-shift by post-twiddle.

In the following, the extraction and the patching of tone patterns in the MDCT domain is described. Now, some explanations are provided regarding particular MDCT peculiarities. In particular, at first, the provisions for the MDCT are considered.

As can be seen from Equations 4, which comprise an exponential so-called post-twiddle term, the CMDCT has time-shifted basis functions compared to DFT or ODFT. Thus, if it is desired to decouple the absolute phase offset $\phi_0$ of the patched sinusoids from the actual spectral position of patch application, this twiddle should be taken into account.

Embodiments conduct the pattern extraction and the patching in the ODFT domain and post-process the superposition of all patterns by application of said twiddle before the mixing with the MDCT coefficients.

Each patch is obtained by extracting truncated complex ODFT spectra of prototypical sinusoids or sweeps generated according to the following equations. A sinusoid with varying instantaneous frequency (IF) f(t) can be synthesized as $$x(t)=\cos(2\pi\phi(t)) \tag{5}$$

with the instantaneous phase $$\phi(t)=\phi(0)+\int_0^t 2\pi f(t)d\tau \tag{6}$$

For simplicity of the relation between time discrete MDCT and time continuous sinusoid description a normalized sampling rate fs=1 is assumed in the following. The instantaneous frequency (IF) $f(\tau)$ of the sweep templates is chosen such that start and target IF are exactly reached at the time domain aliasing cancellation (TDAC) symmetry points $t_0$=N/4+0.5 and $t_1$=3N/4+0.5 of each MDCT time block of length N, respectively. A linear sweep from frequency $f_0$ to $f_1$ spanning a frequency range $\Delta f=f_1-f_0$ in a time interval of length M=N/2 has an instantaneous frequency (IF)

$$f(t_0+t) = f_0 + \frac{\Delta f}{M}t \tag{7}$$

leading to an instantaneous phase $$\varphi(t_0+t) = \varphi(t_0) + f_0 t + \frac{\Delta f}{2M}t^2 \tag{8}$$

Sinusoids with start and end frequencies of doubled resolution (compared to the MDCT to be employed for pattern synthesis) can be generated by selecting $$f_0 = k\frac{\pi}{2M} \text{ and } f_1 = (k+m)\frac{\pi}{2M},$$

with frequency offset m measured in transform bin indices. Odd indices correspond to "on-bin" frequencies and even indices give "between-bin" frequencies. The phase progress between subsequent frames can be computed as $$\Delta\varphi = \varphi(t_1) - \varphi(t_0) = f_0 M + \frac{\Delta f}{2M}M^2 = k\frac{\pi}{2} + m\frac{\pi}{4} \tag{9}$$

This means that for seamless temporal chaining-up of patterns the phase of each patch should be adjusted by an integer multiple of $$\frac{\pi}{4}$$

depending on the start frequency index k and the frequency offset index m of the preceding pattern. The variable m can also be seen as the sweep rate, where e.g. m=1 denotes a half-bin sweep over the duration of one time block.

Moreover, compensation for integer bin spectral shift may be conducted. The spectral position of these prototypical sinusoids or sweeps is beneficially chosen to be located in the middle of the spectrum in order to minimize cyclic folding errors. Dependent on the spectral distance d of prototypical sinusoid and patching target location, the patch is adapted by post-processing rotations of $d\pi/2$ to obtain a predefined fixed phase independent of patching target location. In other words, a post-processing rotation compensates for the unwanted phase rotation that is inherently caused by the spectral shift.

Now efficiency and accuracy considerations are provided. At first, computational efficiency is considered:

Table I provides operations to realize different post-twiddles. To keep the amount of patterns to be stored reasonably small and, most important, to be able to exploit the fact that rotations by certain simple fractions of $\pi$ can be attained by the operations listed in Table I, the possible frequencies and sweeps should be restricted.

TABLE I (OPERATIONS FOR SIMPLE ROTATIONS)

| rotation | operation | implementation |
|---|---|---|
| 0 | 1 | copy "0" pattern |
| $\frac{\pi}{2}$ | i | swap $\Re$ and $-\Im$ part of "0" pattern |
| $\pi$ | −1 | negate "0" pattern |
| $\frac{3\pi}{2}$ | −i | swap $-\Re$ and $\Im$ part of "0" pattern |
| $\frac{\pi}{4}+\frac{n\pi}{2}$ | dto. | do the above on "$\frac{\pi}{4}$" pattern |

In the following, frequency resolution is considered. These restrictions are, at the same time, necessitated to allow for a perceptually satisfactory reproduction of the parametrically coded signal parts. Since such a signal part may comprise an arbitrary time sequence of tone patterns, each additional degree of freedom multiplicates the number of patterns to be stored or, alternatively, the computational costs for adaptation of the patterns. Thus, it makes good sense to choose the spectral resolution such that no detuning effect is perceived by the average listener in the intended target spectral range.

Trained listeners and musicians are able to perceive detunings down to 5 cents, the average listener might accept deviations of approximately 10 cents (a tenth of a semitone). Therefore, the spectral replacement of sine tones should only be done above a certain cut-off frequency that corresponds to the worst-case scenario of allowable detuning. For example in a 512 band MDCT, at a sampling frequency of 12.8 kHz, the spectral resolution per band is 12.5 Hz. Choosing half-band resolution for the tone patterns, the maximum frequency deviation amounts to 3.125 Hz, which is equal or below 10 cent above a cut-off frequency of approx. 540 Hz.

Now, pattern size is considered. According to embodiments, the patterns to be stored are truncated. The actual size of the patterns depends on the window type that is usually already determined by the transform coder (e.g. sine or Kaiser-Bessel derived (KBD) window for AAC) and the allowable signal-to-noise ratio (SNR). Although complex valued patterns are stored, the actual patching is only done using the real part of the fittingly rotated pattern.

In the following, tone Patterns are considered. At first, stationary Tone Patterns are described.

For the aforementioned reasons the spectral resolution should be chosen twice the nominal resolution of the MDCT. As a consequence, two versions of all pattern need to be stored, one for sinusoids with frequencies that coincide with a bin position (on-bin pattern) and one for frequencies that are located between bin positions (between bin pattern). For smallest possible memory requirements, the patterns symmetry might be exploited by storing only half of the coefficients of the actual pattern.

According to Equation 9 (setting m=0), in any time sequence of these stationary tone patterns, the wrapped phase progress amounts to $\Delta\phi=\pi/2$ or $\Delta\phi=-\pi/2$ for on-bin patterns, and $\Delta\phi=0$ or $\Delta\phi=\pi$ for between-bin patterns. This is due to the oddly frequency stacking of the MDCT.

The absolute wrapped phase can be calculated by $\phi_0+n\,\pi/2$ with n as an integer number $\in\{1, 3\}$ for on-bin patterns and $\in\{2, 4\}$ for between-bin patterns. The choice of the actual integer number depends on the parity of the bin number (even/odd). $\phi_0$ denotes an arbitrary phase offset value. Hence, for purely stationary tone pattern, a post-processing by four alternative rotations is needed in order to fit the patterns to their intended position in the t/f grid of a sequence of MDCT spectra. A choice of $\phi_0+n\,\pi/2$, $n\in\mathbb{N}$ renders these rotations trivial.

Now, frequency sweep patterns are considered.

Due to the spectral resolution being twice the nominal resolution of the MDCT, also two versions of each sweep pattern needs to be stored, one for sweeps with start frequencies that coincide with a bin position and one for start frequencies that are located between bin positions. Moreover, the allowable sweeps are defined to be linear and to cover a half, a full and a one-and-a-half MDCT bin per time block, each in a downward and an upward direction version, resulting in 12 patterns to be stored additionally. For smallest possible memory requirements, sweep patterns might be stored only in one direction; the opposite direction might be derived by temporal mirroring of the pattern. According to Equation 9 (setting $m\in\{1, 3, 5 \ldots\}$), pattern involving half-bin sweep distances necessitate post-processing rotations by $\phi_0+n\,\pi/4$.

Figure 2:
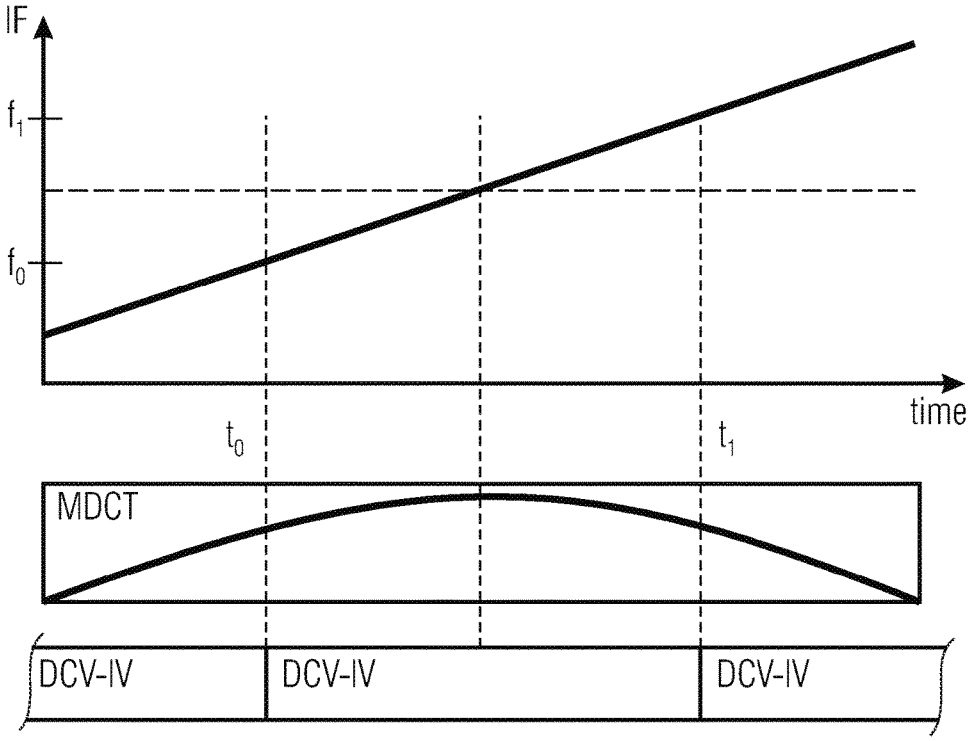
FIG. 2 depicts the parameter alignment of a sweep pattern with respect to an MDCT time block.

In the following, chaining of patterns is considered. For this purpose, reference is made to FIG. 2. FIG. 2 illustrates parameter alignment of sinusoidal pattern with respect to MDCT time block. If patterns are chained in a temporal sequence, a start phase for the actual pattern at point $n_0$ of FIG. 2 has to be chosen (using the aforementioned rotations) and the target phase (stop phase) at point $n_1$ has to be stored for seamless continuation with the subsequent pattern.

Sweeps that encompass half-bin sweep distances are post-processed by post-processing rotations by $\phi_0+n\,\pi/4$, for both sweep patterns and stationary patterns, since sweeps and stationary parts might be arbitrarily chained in a time sequence. A choice of $\phi_0+n\,\pi/4$, $n\in N$ results in a rotation that is also rather easy-to-compute by sum/difference of real and imaginary part of the pattern and a subsequent scaling by $$\frac{\sqrt{2}}{2}.$$

Alternatively, all patterns might be additionally stored in a $\pi/4$ pre-rotated version and can be applied together with a trivial post-processing rotation by $n\,\pi/2$, n=1, 2, 3 (see Table 1).

Figure 3:
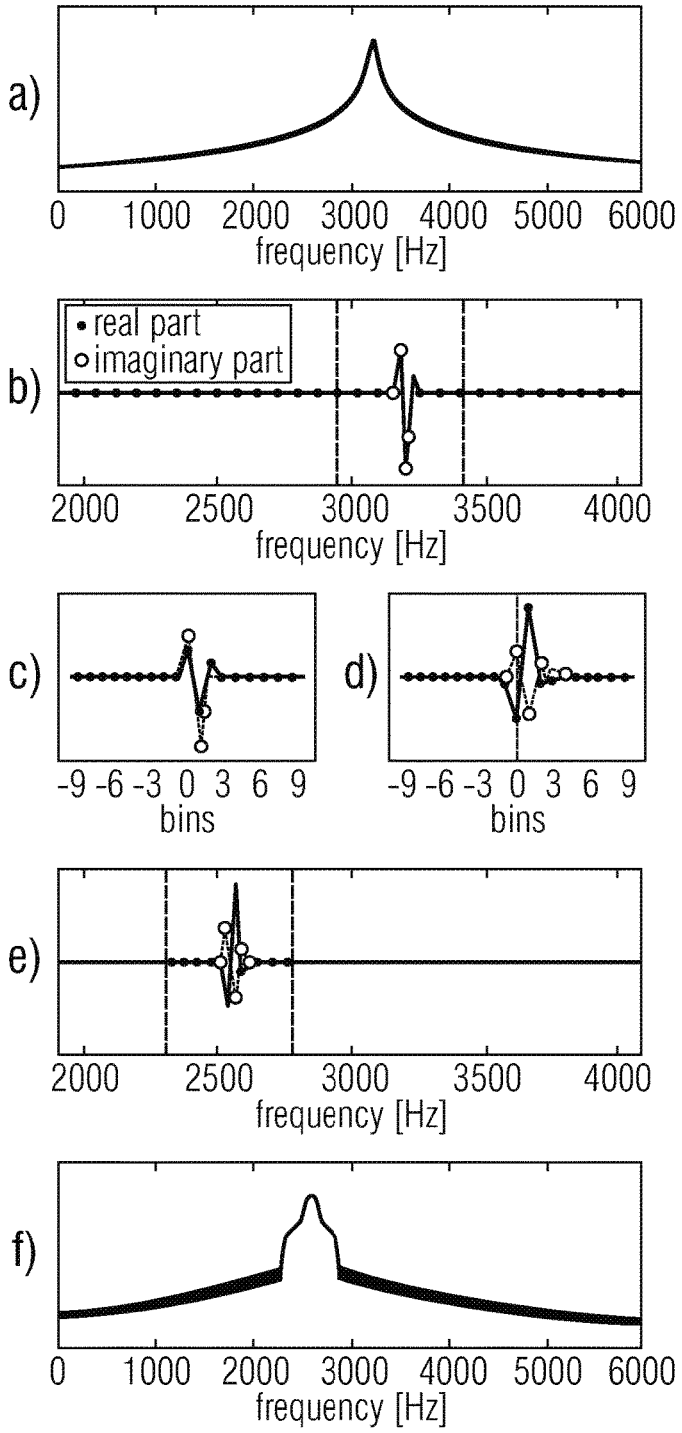
FIG. 3 shows the patching process of a tone pattern, wherein (a-b) illustrate prototypical pattern generation, wherein (c) illustrates pattern truncation, wherein (d) illustrates pattern adaption to target location and phase, and wherein (e-f) illustrate pattern patching.

FIG. 3 illustrates an exemplary tone patterns patching process, wherein (a-b) illustrate prototypical pattern generation, wherein (c) illustrates pattern truncation, wherein (d) illustrates pattern adaption to target location and phase, and wherein (e-f) illustrate pattern patching.

In particular, in FIG. 3 panel (a)-(f), the entire process, as described above with respect to the MDCT peculiarities, from pattern measurement up to pattern adaptation and patching is depicted. At first, a pattern is constructed by generating a sine or a sweep according to Equations 5 and 6. Then, the generated signal is transformed to ODFT frequency domain (a) to obtain a complex spectrum (b). Next, the complex pattern is truncated to its intended length (c) and stored in a table.

Whenever the pattern is needed in order to synthesize a tonal signal portion, it is adapted to its target phase as described in above, with respect to the chaining of patterns, and additionally it is compensated for the phase rotation induced by the spectral shift as above described with respect to the compensation for the integer bin spectral shift (d). Further, the time shift that is present in the CMDCT with respect to the ODFT is implemented by applying a post-twiddle as described above. Applying the post-twiddle can be done efficiently after summing up the contribution of all patterns to be patched into the spectrum (e). Lastly, the actual patching happens in the MDCT domain using only the real part of the adapted pattern. An IMDCT yields the desired time domain signal, the spectrum of which is depicted in panel (f).

Figure 4:
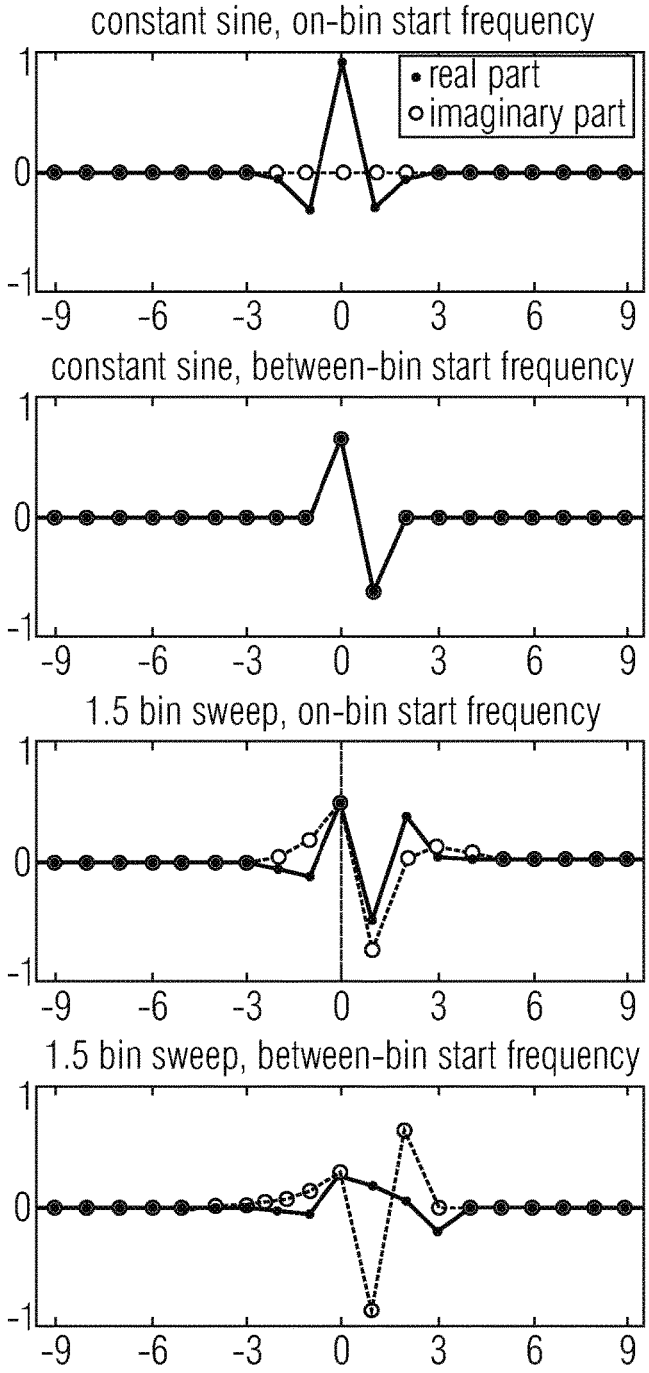
FIG. 4 illustrates normalized spectral tone patterns: sine on-bin, sine between-bin, sweep on-bin, sweep between-bin (from top to bottom panel)

FIG. 4 illustrates normalized spectral tone patterns according to an embodiment, in particular, sine on-bin, sine between-bin, sweep on-bin, sweep between-bin (from top to bottom panel). More particularly, FIG. 4 exemplarily depicts a selection of different tone patterns for a typical low bit rate transform codec scenario using a 512 band MDCT, with sine window, at a sampling frequency of 12.8 kHz, and a half-bin resolution for the tone patterns. From the top to the bottom panel, several normalized spectral ODFT tone patterns are plotted: sine on-bin, sine between-bin, sweep on-bin and sweep between-bin. Several patterns like these have to be stored in a table.

All pattern types are stored in 4 variants:

on-bin and between-bin start phase 0 and start phase $\pi/4$ (pre-rotated, as described above with respect to the chaining up of patterns)

Sweep patterns have additional 6 variants:

half, full and one-and-a-half bin sweep up and down sweep direction

The total number of patterns to be stored is 4 times (1 stationary+6 sweeps) and amounts to 28 complex patterns.

For smallest possible memory requirements, sweep patterns can alternatively be stored only in one direction; the opposite direction can be derived by spectral processing that is dual to temporal mirroring of the pattern. Typically, this can be obtained in a frequency domain by computing the complex conjugate (by multiplication of the imaginary part by −1) of the pattern and applying a complex phase term (twiddle) that depends on the actual domain (ODFT, CMDCT, etc.).

The signal quality that can be obtained by synthesizing truncated spectral patterns depends on the window type, which is usually already determined by the transform codec, and on the actual choice of pattern length, which can be adapted to the overall perceptual quality of the codec and the available resources (memory, computational complexity).

Figure 5:
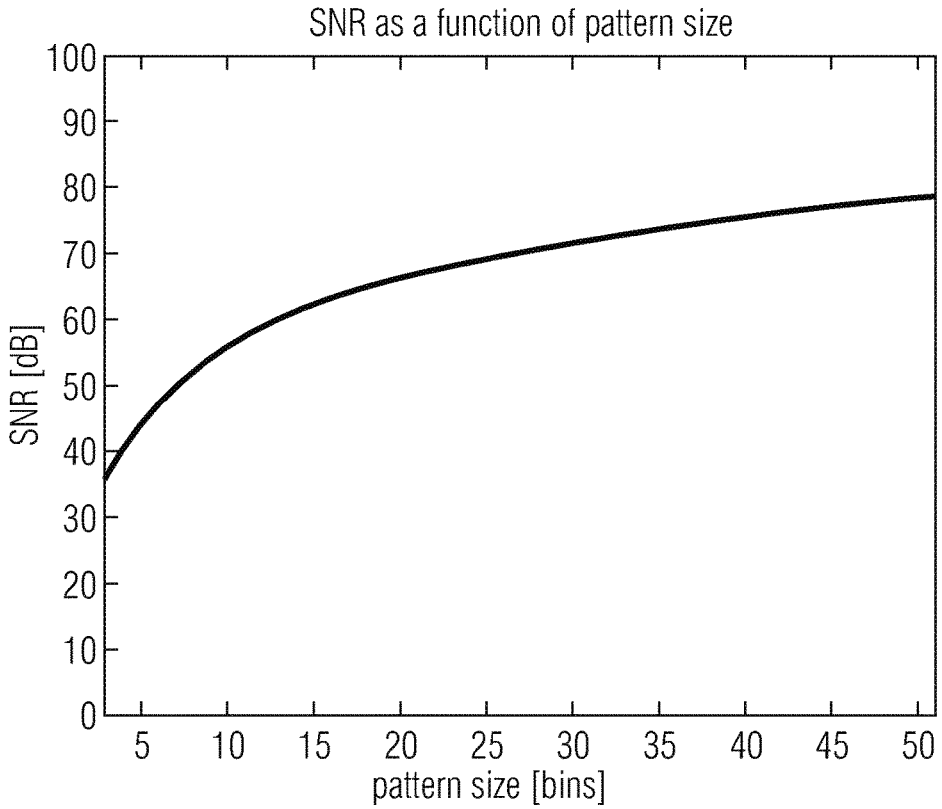
FIG. 5 depicts a signal to noise ratio (SNR) of truncated tone pattern as a function of pattern length for a sine window.

FIG. 5 illustrates a signal to noise ratio (SNR) of truncated tone pattern as a function of pattern length for a sine window. In particular, FIG. 5 shows the mean SNR as a function of pattern length for the sine window. In the scenario described with respect to FIG. 3, truncating the patterns to e.g. 19 bins yields an average SNR of approximately 65 dB. If a lower SNR is acceptable, e.g. in a very low bit rate codec, already a pattern length of 5 bins might be sufficient.

FIG. 6*a* depicts a variation of the illustration of FIG. 2, wherein FIG. 6*a* illustrates an instantaneous frequency at points in time for overlapping blocks according to embodiments.

Figure 6B:
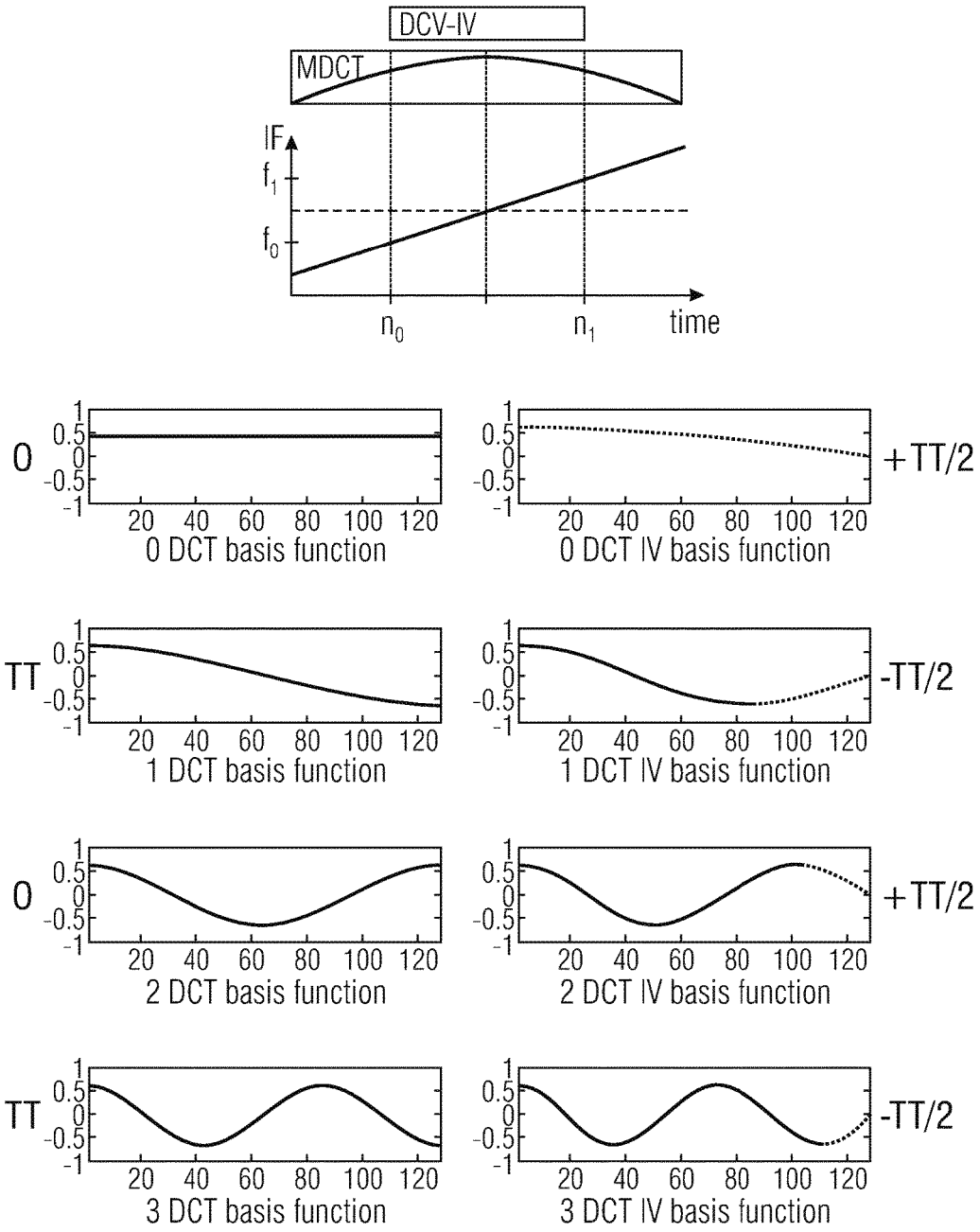
FIG. 6*b* depicts a phase progress for DCT and DCT IV basis functions according to embodiments.

FIG. 6*b* illustrates a phase progress for DCT and DCT IV basis functions according to embodiments with respect to the diagram provided by FIG. 6*a*.

Figure 6C:
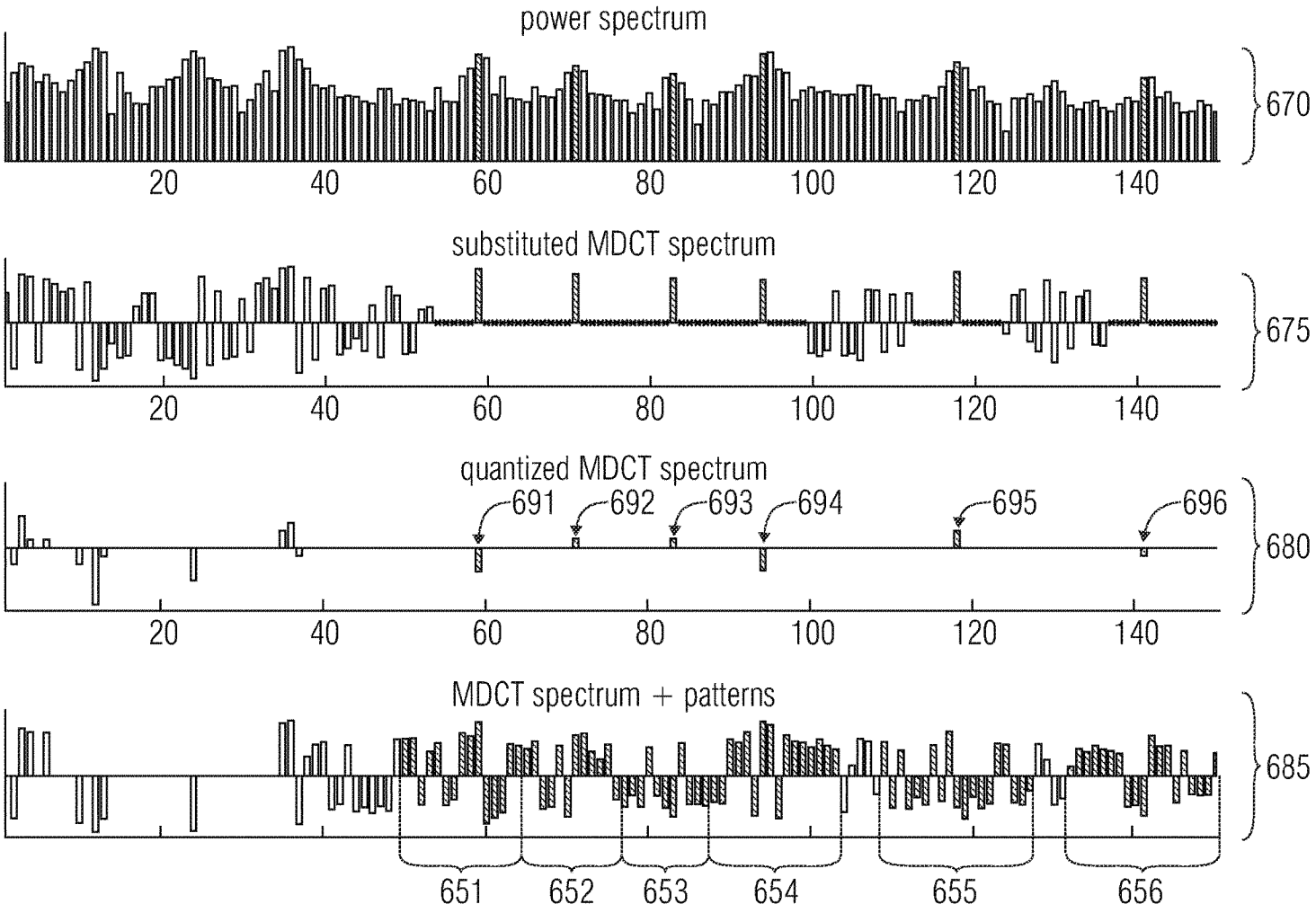
FIG. 6*c* illustrates a power spectrum, a substituted MDCT spectrum, a quantized MDCT spectrum and an MDCT spectrum with patterns according to an embodiment.

FIG. 6*c* illustrates a power spectrum 670, a substituted MDCT spectrum 675, a quantized MDCT spectrum 680 and an MDCT spectrum with patterns 685 according to an embodiment.

The quantized MDCT spectrum 680 has been generated on an encoder side by quantizing the substituted MDCT spectrum 675. The substituted MDCT spectrum 675 has been generated based on an audio signal input spectrum (not shown) as described from the encoder above and based on a power spectrum 670.

The quantized MDCT spectrum 680 will be obtained on a decoder side by processing an encoded audio signal spectrum (not shown) to obtain the quantized MDCT spectrum 680 as a decoded audio signal spectrum.

As can be seen in FIG. 6*c*, the pseudo coefficients 691, 692, 693, 694, 695 and 696 in the decoded audio signal spectrum 680 are replaced by spectral patterns 651, 652, 653, 654, 655 and 656, respectively.

For the same low bit rate codec scenario as above the computational complexity of the newly proposed tone pattern synthesis was compared against the computational complexity of a plain bank of oscillators in time domain. It was assumed that a maximum of 20 sinusoidal tracks are active while coding a monophonic item in a complete perceptual codec setup at a rather low bit rate of 13.2 kbps. The computational workload was measured in the codec's C implementation. The items used for the measurements each contained at least one dominant tonal instrument with rich overtone content (e.g. pitch pipe, violin, harpsichord, saxophon pop, brass ensemble). On average, the computational complexity of the tone pattern based synthesis is only 10% of the straight forward implementation using a bank of oscillators in time domain.

The above-described embodiments provide concepts to enhance low bit rate MDCT based audio coders by the generation of parametric sinusoids and sine sweeps. Applying the provided concepts, such signals can be generated very efficiently in the decoder using tone patterns that are adapted by post-processing phase rotations. For the actual synthesis of these tone patterns, the coder's IMDCT filter bank may be co-used. As described above, the initial choice of the spectral resolution determines a lower cut-off frequency for perceptually appropriate tone generation, the storage memory demand and the computational complexity of the necessitated pattern post-processing. In an exemplary low bit rate audio codec scenario, a computational complexity reduction of 90% at an SNR of 65 dB has been achieved compared to the implementation of a bank of time domain oscillators.

While one solution would employ a bank of oscillators in the time domain at a full sample rate, such a solution would allow for a smooth interpolation between subsequent parameters. However, this solution is computationally heavy.

It is advantageous for low computationally complexity to employ MDCT ToneFilling (TF) spectral patterns. There, spectra may be patched with TF patterns at block sample rate. Truncated spectral patterns may be stored, for example, in a table, e.g. a table of a database or of a memory.

In embodiments an "interpolation" of sinusoidal tracks of an amplitude by 50% overlapping synthesis window and of a frequency by choice of sweep patterns with appropriate slope is provided, which is computationally very efficient.

Embodiments provide time domain pattern design for minimum aliasing. The phase and instantaneous frequency (IF) exactly match at points in time where overlapping blocks have equal weights.

As can be seen in FIG. 6*a*, symmetry points are located at $n_0$: ¼*b_length+0.5; and $n_1$: ¾*b_length+0.5.

To seamlessly fit a sinusoidal track, according to an embodiment, patterns are chosen from integer bin pattern ("on-bin position"), fractional bin pattern ("between-bins position") and linear sweeps: half, full and one-and-a-half bin sweep.

The chosen patterns are adapted to intended location in MDCT t/f grid by conducting amplitude scaling, and, with respect to the phase, by conducting a complex rotation (twiddle) as a function of pattern source location, target location, temporal predecessor phase.

Due to the limited frequency resolution, only a discrete set of predefined rotations is needed, in particular:

$N*\pi/2$ rotations via permutation of the real and the imaginary part and sign; and $N*\pi/4$ rotations implemented by $\pi/4$ pre-rotated patterns.

Implementing an MDCT time shift necessitates a patterns/patching in the ODFT domain. A half bin resolution is realized by a $\pi/2$ phase granularity, and two different pattern types.

An ODFT/DCT-IV frequency shift is realized by an integer bin patterns progress phase by $+\pi/2$ or $-\pi/2$, by a fractional bin patterns progress phase by 0 or $\pi$, and is dependent on parity of bin number (even/odd). This is illustrated by FIG. 6*b*.

In embodiments, all patterns are stored in 4 variants, covering the combinations of the alternatives:

integer bin or fractional bin;

$\phi=0$ or $\phi=\pi/4$ (pre-rotated, needed for handling half bin sweeps)

In embodiments, sweep patterns have additional 6 variants covering the combinations of the alternatives;

half, full or one-and-a-half bin sweep; and up or down

This results in a total number of: 4*(1 stationary+6 sweeps)=28 complex patterns. The actual patch is the real part of the final (rotated) pattern.

The provided concepts may, for example, employed for USAC, in particular in the transform coding signal path.

Summarizing the above, MDCT is critical for coding tonal signals at low bit rates due to occurrence of warbling artifacts. The classic psychoacoustic model, however, does not account for this. Thus, a least annoyance model needed. Parametric coding tools can help at low bit rates. ToneFilling artifacts might be less annoying than warbling.

Efficient implementation of ToneFilling oscillators can be achieved by patching of t/f adapted MDCT patterns. By employing ToneFilling, decent quality in low bit rate and low delay coding of tonal music is obtained.

In the following, a description regarding some further embodiments is provided.

Figure 10:
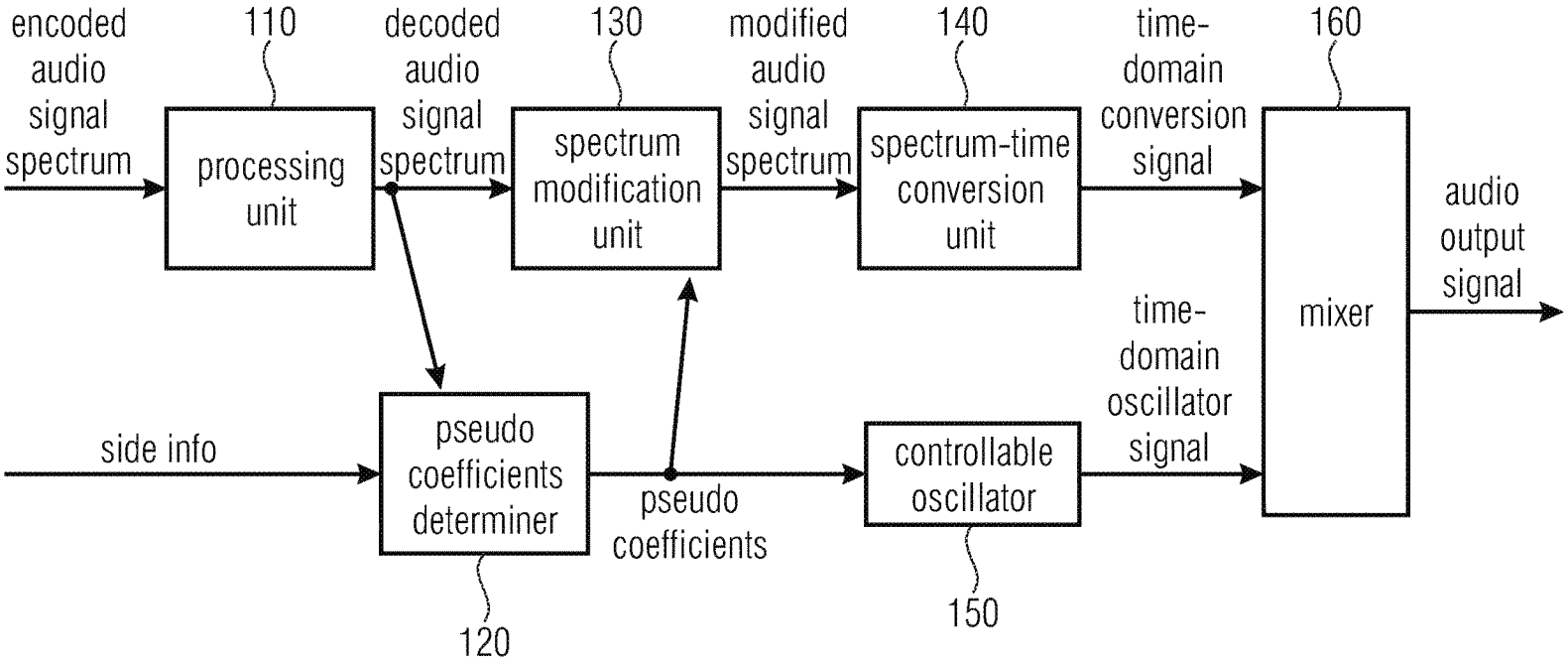
FIG. 10 illustrates an apparatus for generating an audio output signal based on an encoded audio signal spectrum according to an embodiment.

FIG. 10 illustrates an apparatus for generating an audio output signal based on an encoded audio signal spectrum.

The apparatus comprises a processing unit 110 for processing the encoded audio signal spectrum to obtain a decoded audio signal spectrum. The decoded audio signal spectrum comprises a plurality of spectral coefficients, wherein each of the spectral coefficients has a spectral location within the encoded audio signal spectrum and a spectral value, wherein the spectral coefficients are sequentially ordered according to their spectral location within the encoded audio signal spectrum so that the spectral coefficients form a sequence of spectral coefficients.

Moreover, the apparatus comprises a pseudo coefficients determiner 120 for determining one or more pseudo coefficients of the decoded audio signal spectrum using side information (side info), each of the pseudo coefficients having a spectral location and a spectral value.

Furthermore, the apparatus comprises a spectrum modification unit 130 for setting the one or more pseudo coefficients to a predefined value to obtain a modified audio signal spectrum.

Moreover, the apparatus comprises a spectrum-time conversion unit 140 for converting the modified audio signal spectrum to a time-domain to obtain a time-domain conversion signal.

Furthermore, the apparatus comprises a controllable oscillator 150 for generating a time-domain oscillator signal, the controllable oscillator being controlled by the spectral location and the spectral value of at least one of the one or more pseudo coefficients.

Moreover, the apparatus comprises a mixer 160 for mixing the time-domain conversion signal and the time-domain oscillator signal to obtain the audio output signal.

In an embodiment, the mixer may be configured to mix the time-domain conversion signal and the time-domain oscillator signal by adding the time-domain conversion signal to the time-domain oscillator signal in the time-domain.

The processing unit 110 may, for example, be any kind of audio decoder, for example, an MP3 audio decoder, an audio decoder for WMA, an audio decoder for WAVE-files, an AAC audio decoder or an USAC audio decoder.

The processing unit 110 may, for example, be an audio decoder as described in [8] (ISO/IEC 14496-3:2005—Information technology—Coding of audio-visual objects—Part 3: Audio, Subpart 4) or as described in [9] (ISO/IEC 14496-3:2005—Information technology—Coding of audio-visual objects—Part 3: Audio, Subpart 4). For example, the processing unit 430 may comprise a rescaling of quantized values ("de-quantization"), and/or a temporal noise shaping tool, as, for example, described in [8] and/or the processing unit 430 may comprise a perceptual noise substitution tool, as, for example, described in [8].

According to an embodiment, each of the spectral coefficients may have at least one of an immediate predecessor and an immediate successor, wherein the immediate predecessor of said spectral coefficient may be one of the spectral coefficients that immediately precedes said spectral coefficient within the sequence, wherein the immediate successor of said spectral coefficient may be one of the spectral coefficients that immediately succeeds said spectral coefficient within the sequence.

The pseudo coefficients determiner 120 may be configured to determine the one or more pseudo coefficients of the decoded audio signal spectrum by determining at least one spectral coefficient of the sequence, which has a spectral value which is different from the predefined value, which has an immediate predecessor the spectral value of which is equal to the predefined value, and which has an immediate successor the spectral value of which is equal to the predefined value. In an embodiment, the predefined value may be zero and the predefined value may be zero.

In other words: The pseudo coefficients determiner 120 determines for some or all of the coefficients of the decoded audio signal spectrum whether the respectively considered coefficient is different from the predefined value (advantageously: different from 0), whether the spectral value of the preceding coefficient is equal to the predefined value (advantageously: equal to 0) and whether the spectral value of the succeeding coefficient is equal to the predefined value (advantageously: equal to 0).

In some embodiments, such a determined coefficient is a pseudo coefficient.

In other embodiments, however, such a determined coefficient is (only) a pseudo coefficient candidate and may or may not be a pseudo coefficient. In those embodiments, the pseudo coefficients determiner 120 is configured to determine the at least one pseudo coefficient candidate, which has a spectral value which is different from the predefined value, which has an immediate predecessor, the spectral value of which is equal to the predefined value, and which may have an immediate successor, the spectral value of which is equal to the predefined value.

The pseudo coefficients determiner 120 is then configured to determine whether the pseudo coefficient candidate is a pseudo coefficient by determining whether side information indicates that said pseudo coefficient candidate is a pseudo coefficient.

For example, such side information may be received by the pseudo coefficients determiner 120 in a bit field, which indicates for each of the spectral coefficients of the quantized audio signal spectrum which has an immediate predecessor the spectral value of which is equal to the predefined value and an immediate successor, the spectral value of which is equal to the predefined value, whether said coefficient is one of the extremum coefficients (e.g. by a bit value 1) or whether said coefficient is not one of the extremum coefficients (e.g. by a bit value 0).

E.g., a bit field [000111111] might indicate, that the first three "stand-alone" coefficients (their spectral value is not equal to the predefined value, but the spectral values of their predecessor and of their successor are equal to the predefined value) that appear in the (sequentially ordered) (quantized) audio signal spectrum are not extremum coefficients, but the next six "stand-alone" coefficients are extremum coefficients. This bit field describes the situation that can be seen in the quantized MDCT spectrum 635 in FIG. 9, where the first three "stand-alone" coefficients 5, 8, 25 are not extremum coefficients, but where the next six "stand-alone" coefficients 59, 71, 83, 94, 116, 141 are extremum coefficients.

The spectrum modification unit 130 may be configured to "delete" the pseudo coefficients from the decoded audio signal spectrum. In fact, the spectrum modification unit sets the spectral value of the pseudo coefficients of the decoded audio signal spectrum to the predefined value (advantageously to 0). This is reasonable, as the (at least one) pseudo coefficients will only be needed to control the (at least one) controllable oscillator 150. Thus, consider, for example, the quantized MDCT spectrum 635 in FIG. 9. If the spectrum 635 is considered as the decoded audio signal spectrum, the spectrum modification unit 130 would set the spectral values of the extremum coefficients 59, 71, 83, 94, 116 and 141 to obtain the modified audio signal spectrum and would leave the other coefficients of the spectrum unmodified.

The spectrum-time conversion unit 140 converts the modified audio signal spectrum from a spectral domain to a time-domain. For example, the modified audio signal spectrum may be an MDCT spectrum, and the spectrum-time conversion unit 140 may be an Inverse Modified Discrete Cosine Transform (IMDCT) filter bank. In other embodiments, the spectrum may be an MDST spectrum and the spectrum-time conversion unit 140 may be an Inverse Modified Discrete Sine Transform (IMDST) filter bank. Or, in further embodiments, the spectrum may be a DFT spectrum and the spectrum-time conversion unit 140 may be an Inverse Discrete Fourier Transform (IDFT) filter bank.

The controllable oscillator 150 may be configured to generate the time-domain oscillator signal having a oscillator signal frequency so that the oscillator signal frequency of the oscillator signal may depend on the spectral location of one of the one or more pseudo coefficients. The oscillator signal generated by the oscillator may be a time-domain sine signal. The controllable oscillator 150 may be configured to control the amplitude of the time-domain sine signal depending on the spectral value of one of the one or more pseudo coefficients.

According to an embodiment, the pseudo coefficients are signed values, each comprising a sign component. The controllable oscillator 150 may be configured to generate the time-domain oscillator signal so that the oscillator signal frequency of the oscillator signal furthermore may depend on the sign component of one of the one or more pseudo coefficients so that the oscillator signal frequency may have a first frequency value, when the sign component has a first sign value, and so that the oscillator signal frequency may have a different second frequency value, when the sign component has a different second value.

For example, consider the pseudo coefficient at spectral location 59 in the MDCT spectrum 635 of FIG. 9. If frequency 8200 Hz would be assigned to spectral location 59 and if frequency 8400 Hz would be assigned to spectral location 60, then, the controllable oscillator may, for example, be configured set the oscillator frequency to 8200 Hz, if the sign of the of the spectral value of the pseudo coefficient is positive, and may, for example, be configured set the oscillator frequency to 8300 Hz, if the sign of the spectral value of the pseudo coefficient is negative.

Thus, the sign of the spectral value of the pseudo coefficient can be used to control, whether the controllable oscillator sets the oscillator frequency to a frequency (e.g. 8200 Hz) assigned to the spectral location derived from the pseudo coefficient (e.g. spectral location 59) or to a frequency (e.g. 8300 Hz) between the frequency (e.g. 8200 Hz) assigned to the spectral location derived from the pseudo coefficient (e.g. spectral location 59) and the frequency (e.g. 8400 Hz) assigned to the spectral location that immediately follows the spectral location derived from the pseudo coefficient (e.g. spectral location 60).

Figure 11:
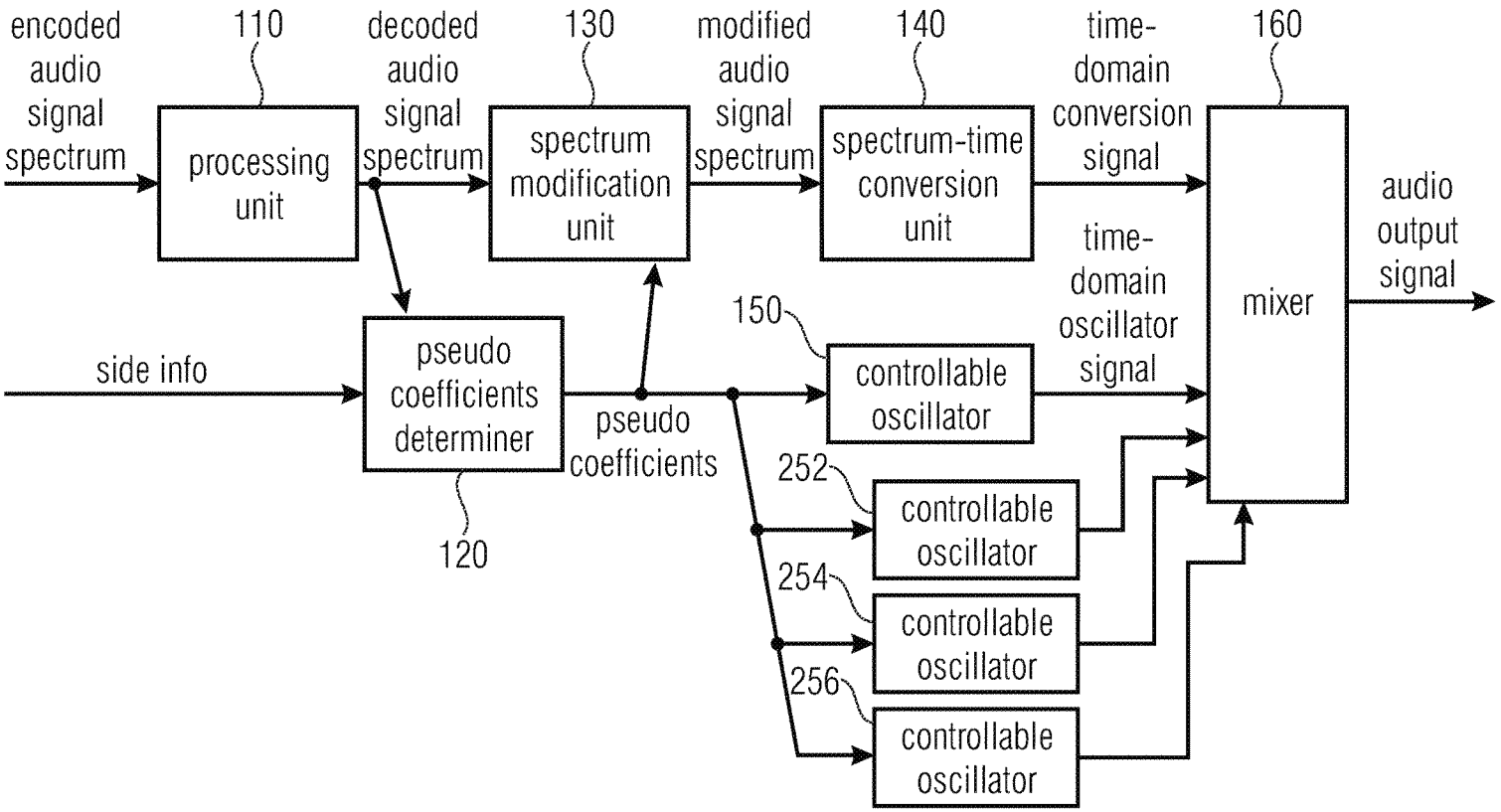
FIG. 11 depicts an apparatus for generating an audio output signal based on an encoded audio signal spectrum according to another embodiment.

FIG. 11 illustrates an embodiment, wherein the apparatus comprises further controllable oscillators 252, 254, 256 for generating further time-domain oscillator signals controlled by the spectral values of further pseudo coefficients of the one or more pseudo coefficients. The further controllable oscillators 252, 254, 256 each generate one of the further time-domain oscillator signals. Each of the controllable oscillators 252, 254, 256 is configured to steer the oscillator signal frequency based on the spectral location derived from one of the pseudo coefficients. And/or each of the controllable oscillators 252, 254, 256 is configured to steer the amplitude of the oscillator signal based on the spectral value of one of the pseudo coefficients.

The further controllable oscillators 252, 254, 256 each generate one of the further time-domain oscillator signals. Each of the controllable oscillators 252, 254, 256 is configured to steer the oscillator signal frequency based on the spectral location of one of the pseudo coefficients. And/or each of the controllable oscillators 252, 254, 256 is configured to steer the amplitude of the oscillator signal based on the spectral value of one of the pseudo coefficients.

The mixer 160 of FIG. 10 and FIG. 11 is configured to mix the time-domain conversion signal generated by the spectrum-time conversion unit 140 and the one or more time-domain oscillator signal generated by the one or more controllable oscillators 150, 252, 254, 256 to obtain the audio output signal. The mixer 160 may generate the audio output signal by a superposition of the time-domain conversion signal and the one or more time-domain oscillator signals.

Figure 12:
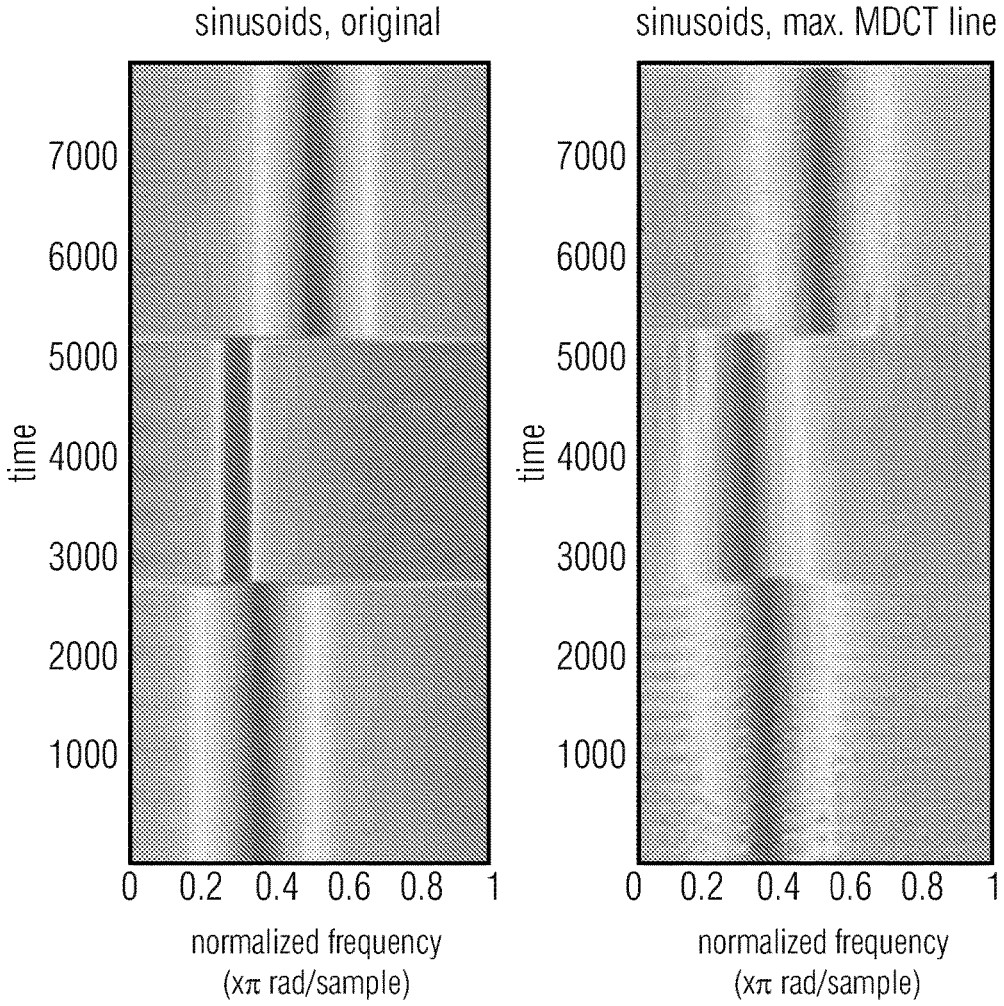
FIG. 12 shows two diagrams comparing original sinusoids and sinusoids after processed by an MDCT/inverse MDCT chain.

FIG. 12 illustrates two diagrams comparing original sinusoids (left) and sinusoids after processed by an MDCT/IMDCT chain (right). After being processed by the MDCT/IMDCT chain, the sinusoid comprises warbling artifacts. The concepts provided above avoid that sinusoids are processed by the MDCT/IMDCT chain, but instead, sinusoidal information is encoded by a pseudo coefficient and/or the sinusoid is reproduced by a controllable oscillator.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] Daudet, L.; Sandler, M., "MDCT analysis of sinusoids: exact results and applications to coding artifacts reduction," Speech and Audio Processing, IEEE Transactions on. vol. 12, no. 3, pp, 302-312, May 2004

[2] Purnhagen, H.; Meine, N.; "HILN—the MPEG-4 parametric audio coding tools," *Circuits and Systems,* 2000. *Proceedings. ISCAS* 2000 *Geneva. The* 2000 *IEEE International Symposium an*, vol. 3, no., pp. 201-204 vol. 3, 2000

[3] Oomen, Werner; Schuijers, Erik; den Brinker, Bert; Breebaart, Jeroen:" Advances in Parametrie Coding for High-Quality Audio," Audio Engineering Society Convention 114, preprint, Amsterdam/NL, March 2003

[4] van Schijndel, N. H.; van de Par, S.; "Rate-distortion optimized hybrid sound coding," Applications of Signal Processing to Audio and Acoustics, 2005. IEEE Workshop on, vol., no., pp. 235-238, 16-19 Oct. 2005

[5] Bessette, 8.; Lefebvre, R.; Salami, R.; "Universal speech/audio coding using hybrid ACELP/TCX techniques," Acoustics, Speech, and Signal Processing, 2005. Proceedings. (ICASSP '05). IEEE International Conference on, vol. 3, no., pp. iii/301-iii/304 Val. 3, 18-23 Mar. 2005

[6] Ferreira, A. J. S. "Combined spectral envelope normalization and subtraction of sinusoidal components in the ODFT and MDCT frequency domains," Applications of Signal Processing to Audio and Acoustics, 2001 IEEE Workshop on the, vol., no., pp. 51-54, 2001

[7] http://people.xiph.org/~xiphmont/demo/ghost/demo.html The corresponding archive.org-website is stored at: http://web.archive.org/web/20110121141149/http://people.xiph.org/~xiphmont/demo/ghost/demo.html

[8] ISO/IEC 14496-3:2005(E)—Information technology—Coding of audio-visual objects—Part 3: Audio, Subpart 4

[9] ISO/IEC 14496-3:2009(E)—Information technology—Coding of audio-visual objects—Part 3: Audio, Subpart 4

[10] Anibal J. S. Ferreira. Perceptual coding using sinusoidal modeling in the mdct domain. In *Audio Engineering Society Convention* 112, 4 2002.

[11] Deepen Ferreira, Anibal J. S.; Sinha. Accurate spectral replacement. In *Audio Engineering Society Convention JJ* 8, 5 2005.

[12] Rade Kutil. Optimized sinusoid synthesis via inverse truncated fourier transform. *Trans. Audio. Speech and Lang. Proc.,* 17(2):221-230, February 2009.

[13] Nikolaus Meine and Heiko Purnhagen. Fast sinusoid synthesis for mpeg-4 hiln parametric audio decoding. *Proc. of the* 5 *th Int. Conference on Digital Audio Effects* (*DAFx*-02), Hamburg, Germany, Sep. 26-28, 2002, 0(0), 2002.

The invention claimed is:

1. An apparatus for generating an audio output signal based on an encoded audio signal spectrum, wherein the apparatus comprises:

a processing unit for processing the encoded audio signal spectrum to acquire a decoded audio signal spectrum comprising a plurality of spectral coefficients, wherein each of the spectral coefficients comprises a spectral location within the encoded audio signal spectrum and a spectral value, wherein the spectral coefficients are sequentially ordered according to their spectral location within the encoded audio signal spectrum so that the spectral coefficients form a sequence of spectral coefficients, a pseudo coefficients determiner for determining one or more pseudo coefficients of the decoded audio signal spectrum, wherein each of the pseudo coefficients is one of the spectral coefficients, a replacement unit for replacing at least one or more pseudo coefficients by a determined spectral pattern to acquire a modified audio signal spectrum, wherein the determined spectral pattern comprises at least two pattern coefficients, wherein each of the at least two pattern coefficients comprises a spectral value, and a spectrum-time-conversion unit for converting the modified audio signal spectrum to a time-domain to acquire the audio output signal.

2. The apparatus according to claim 1, wherein the apparatus furthermore comprises a storage unit comprising a database or a memory having stored within the database or within the memory a plurality of stored spectral patterns, wherein each of the stored spectral patterns comprises a spectral property, wherein the replacement unit is configured to request one of the stored spectral patterns from the storage unit as a requested spectral pattern, wherein the storage unit is configured to provide the requested spectral pattern, and wherein the replacement unit is configured to replace the at least one or more pseudo coefficients by the determined spectral pattern based on the requested spectral pattern.

3. The apparatus according to claim 2, wherein the replacement unit is configured to request said one of the stored spectral patterns from the storage unit depending on a first derived spectral location derived from at least one of the one or more pseudo coefficients determined by the pseudo coefficients determiner.

4. The apparatus according to claim 3, wherein the one or more pseudo coefficients are signed values, each comprising a sign component, and wherein the replacement unit is configured to determine the first derived spectral location based on the spectral location of one pseudo coefficient of the one or more pseudo coefficients and based on the sign component of said pseudo coefficient, so that the first derived spectral location is equal to the spectral location of said pseudo coefficient when the sign component comprises a first sign value, and so that the first derived spectral location is equal to a modified location, the modified location resulting from shifting the spectral location of said pseudo coefficient by a predefined value when the sign component comprises a different second value.

5. The apparatus according to claim 3, wherein the plurality of stored spectral patterns being stored within the database or the memory of the storage unit are either stationary tone patterns or frequency sweep patterns, wherein the pseudo coefficients determiner is configured to determine two or more temporally consecutive pseudo coefficients of the decoded audio signal spectrum, wherein the replacement unit is configured to assign a first pseudo coefficient and a second pseudo coefficient of the two or more temporally consecutive pseudo coefficients to a track depending on whether an absolute difference between the first derived spectral location derived from the first pseudo coefficient and a second derived spectral location derived from the second pseudo coefficient is smaller than a threshold value, and wherein the replacement unit is configured to request one of the stationary tone patterns from the storage unit when the first derived spectral location derived from the first pseudo coefficient of the track is equal to the second derived spectral location derived from the second pseudo coefficient of the track, and wherein the replacement unit is configured to request one of the frequency sweep patterns from the storage unit when the first derived spectral location derived from the first pseudo coefficient of the track is different from the second derived spectral location derived from the second pseudo coefficient of the track.

6. The apparatus according to claim 5, wherein the replacement unit is configured to request a first frequency sweep pattern of the frequency sweep patterns from the storage unit when a frequency difference between the second derived spectral location derived from the second pseudo coefficient of the track and the first derived spectral location derived from the first pseudo coefficient of the track is equal to half of a predefined value, wherein the replacement unit is configured to request a second frequency sweep pattern, being different from the first frequency sweep pattern, of the frequency sweep patterns from the storage unit when the frequency difference between the second derived spectral location derived from the second pseudo coefficient of the track and the first derived spectral location derived from the first pseudo coefficient of the track is equal to the predefined value, and wherein the replacement unit is configured to request a third frequency sweep pattern, being different from the first sweep pattern and the second frequency sweep pattern, of the frequency sweep patterns from the storage unit when the frequency difference between the second derived spectral location derived from the second pseudo coefficient of the track and the first derived spectral location derived from the first pseudo coefficient of the track is equal to one and a half times the predefined value.

7. The apparatus according to claim 2, wherein the replacement unit comprises a pattern adaptation unit being configured to modify the requested spectral pattern provided by the storage unit to acquire the determined spectral pattern.

8. The apparatus according to claim 7, wherein the pattern adaptation unit is configured to modify the requested spectral pattern provided by the storage unit by rescaling the spectral values of the pattern coefficients of the requested spectral pattern depending on the spectral value of one of the one or more pseudo coefficients.

9. The apparatus according to claim 7, wherein the pattern adaptation unit is configured to modify the requested spectral pattern provided by the storage unit depending on a start phase so that the spectral value of each of the pattern coefficients of the requested spectral pattern is modified in a first way, when the start phase comprises a first start phase value, and so that the spectral value of each of the pattern coefficients of the requested spectral pattern is modified in a different second way, when the start phase comprises a different second start phase value.

10. The apparatus according to claim 7, wherein the spectral value of each of the pattern coefficients of the requested spectral pattern is a complex coefficient comprising a real part and an imaginary part, and wherein the pattern adaptation unit is configured to modify the requested spectral pattern by modifying the real part and the imaginary part of each of the pattern coefficients of the requested spectral pattern provided by the storage unit by applying a complex rotation factor $e^{j\cdot\Phi}$, wherein $\phi$ is an angle value.

11. The apparatus according to claim 7, wherein the spectral value of each of the pattern coefficients of the requested spectral pattern is a complex coefficient comprising a real part and an imaginary part, and wherein the pattern adaptation unit is configured to modify the requested spectral pattern provided by the storage unit by negating the real and the imaginary part of the spectral value of each of the pattern coefficients of the requested spectral pattern, or by swapping the real part or a negated real part and the imaginary part or a negated imaginary part of the spectral value of each of the pattern coefficients of the requested spectral pattern.

12. The apparatus according to claim 7, wherein the pattern adaptation unit is configured to modify the requested spectral pattern provided by the storage unit by realizing a temporal mirroring of the pattern by computing the complex conjugate of the pattern and applying a complex phase term.

13. The apparatus according to claim 7, wherein the decoded audio signal spectrum is represented in an MDCT domain, wherein the pattern adaptation unit is configured to modify the requested spectral pattern provided by the storage unit by modifying the spectral values of the pattern coefficients of the requested spectral pattern to acquire a modified spectral pattern, wherein the spectral values are represented in an Oddly-Stacked Discrete Fourier Transform domain, wherein the pattern adaptation unit is configured to transform the spectral values of the pattern coefficients of the modified spectral pattern from the Oddly-Stacked Discrete Fourier Transform domain to the MDCT domain to acquire the determined spectral pattern, and wherein the replacement unit is configured to replace the at least one or more pseudo coefficients by the determined spectral pattern being represented in the MDCT domain to acquire the modified audio signal spectrum being represented in the MDCT domain.

14. An apparatus for generating a plurality of spectral patterns, comprising:

a signal generator for generating a plurality of signals in a first domain, a signal transformation unit for transforming each signal of the plurality of signals from the first domain to a second domain to acquire a plurality of spectral patterns, each pattern of the plurality of transformed spectral patterns comprising a plurality of coefficients, a postprocessing unit for truncating the transformed spectral patterns by removing one or more of the coefficients of the transformed spectral patterns to acquire a plurality of processed patterns, and a storage unit comprising a database or a memory, wherein the storage unit is configured to store each processed pattern of the plurality of processed patterns in the database or the memory, wherein the signal generator is configured to generate each signal of the plurality of signals based on the formulae $$x(t)=\cos(2\pi\phi(t))$$

and $$\phi(t)=\phi(0)+\int_0^t 2\pi f(\tau)d\tau,$$

wherein t and $\tau$ indicate time, wherein $\phi(t)$ is an instantaneous phase at t, and wherein $f(\tau)$ is an instantaneous frequency at $\tau$, wherein each signal of the plurality of signals comprises a start frequency, being an instantaneous frequency of said signal at a first point-in-time, and a target frequency, being an instantaneous frequency of said signal at a different second point-in-time, wherein the signal generator is configured to generate a first signal of the plurality of signals so that the target frequency of the first signal is equal to the start frequency, and wherein the signal generator is configured to generate a different second signal of the plurality of signals so that the target frequency of the first signal is different from the start frequency.

15. The apparatus according to claim 14, wherein the signal transformation unit is configured to transform each signal of the plurality of signals from the first domain, being a time domain, to a second domain, being a spectral domain, wherein the signal transformation unit is configured to generate a first one of a plurality of time blocks for transforming said signal, wherein each time block of the plurality of time blocks comprises a plurality of weighted samples, wherein each of said weighted samples is a signal sample of said signal being weighted by a weight of a plurality of weights, wherein the plurality of weights are assigned to said time block, and wherein each weight of the plurality of weights is assigned to a point-in-time, wherein the start frequency of each signal of the plurality of signals is an instantaneous frequency of said signal at the first point-in-time, where a first one of the weights of the first one of the time blocks is assigned to the first point-in-time, where a second one of the weights of a different second one of the time blocks is assigned to the first point-in-time, wherein the first one of the time blocks and the second one of the time blocks overlap, and wherein the first one of the weights is equal to the second one of the weights, and wherein the target frequency of each signal of the plurality of signals is an instantaneous frequency of said signal at the second point-in-time, where a third one of the weights of the first one of the time blocks is assigned to the second point-in-time, where a fourth one of the weights of a different third one of the time blocks, is assigned to the second point-in-time, wherein the first one of the time blocks and the third one of the time blocks overlap, and wherein the third one of the weights is equal to the fourth one of the weights.

16. The apparatus according to claim 14, wherein each signal of the plurality of signals comprises a start phase, being a phase of said signal at a first point-in-time, wherein the signal generator is configured to generate the plurality of signals such that the start phase of a first one of the plurality signals is equal to the start phase of a different second one of the plurality of the signals.

17. The apparatus according to claim 14, wherein the postprocessing unit is furthermore configured to conduct a rotation by an arbitrary phase angle on the spectral coefficients of each of the transformed spectral patterns to acquire a plurality of arbitrarily rotated spectral patterns.

18. The apparatus according to claim 14, wherein the postprocessing unit is furthermore configured to conduct a rotation by $\pi/4$ on the spectral coefficients of each of the transformed spectral patterns to acquire a plurality of rotated spectral patterns.

19. The apparatus according to claim 14, wherein the signal generator is configured to generate the first signal, the second signal and one or more further signals as the plurality of signals, so that each difference of the target frequency and the start frequency of each of the further signals is an integer multiple of a difference of the target frequency and the start frequency of the second signal.

20. A method for generating an audio output signal based on an encoded audio signal spectrum, wherein the method comprises:

processing the encoded audio signal spectrum to acquire a decoded audio signal spectrum comprising a plurality of spectral coefficients, wherein each of the spectral coefficients comprises a spectral location within the encoded audio signal spectrum and a spectral value, wherein the spectral coefficients are sequentially ordered according to their spectral location within the encoded audio signal spectrum so that the spectral coefficients form a sequence of spectral coefficients, determining one or more pseudo coefficients of the decoded audio signal spectrum, wherein each of the pseudo coefficients is one of the spectral coefficients, replacing at least one or more pseudo coefficients by a determined spectral pattern to acquire a modified audio signal spectrum, wherein the determined spectral pattern comprises at least two pattern coefficients, wherein each of the at least two pattern coefficients comprises a spectral value, and converting the modified audio signal spectrum to a time-domain to acquire the audio output signal.

21. A method for generating a plurality of spectral patterns, comprising:

generating a plurality of signals in a first domain, transforming each signal of the plurality of signals from the first domain to a second domain to acquire a plurality of spectral patterns, each pattern of the plurality of transformed spectral patterns comprising a plurality of coefficients, truncating the transformed spectral patterns by removing one or more of the coefficients of the transformed spectral patterns to acquire a plurality of processed patterns, and storing each processed pattern of the plurality of processed patterns in a database or a memory, wherein generating each signal of the plurality of signals is conducted based on the formulae $$x(t)=\cos(2\pi\phi(t))$$

and $$\phi(t)=\phi(0)+\int_0^t 2\pi f(\tau)d\tau,$$

wherein t and $\tau$ indicate time, wherein $\phi(t)$ is an instantaneous phase at t, and wherein $f(\tau)$ is an instantaneous frequency at $\tau$, wherein each signal of the plurality of signals comprises a start frequency, being an instantaneous frequency of said signal at a first point-in-time, and a target frequency, being an instantaneous frequency of said signal at a different second point-in-time, wherein generating the plurality of signals is conducted by generating a first signal of the plurality of signals so that the target frequency of the first signal is equal to the start frequency, and wherein generating the plurality of signals is conducted by generating a different second signal of the plurality of signals so that the target frequency of the first signal is different from the start frequency.

22. A non-transitory computer readable medium having stored thereon a computer program for implementing the method of claim 20 when being executed on a computer or signal processor.

23. A non-transitory computer readable medium having stored thereon a computer program for implementing the method of claim 21 when being executed on a computer or signal processor.

* * * * *